US009797679B2

(12) United States Patent
Ponder

(10) Patent No.: US 9,797,679 B2
(45) Date of Patent: Oct. 24, 2017

(54) HANDS-FREE SUPPORT DEVICE, A SUBASSEMBLY OF A HANDS-FREE SUPPORT DEVICE AND METHODS FOR OPERATING THE SAME

(71) Applicant: Wild Bucks Outdoors, LLC, Dayton, TX (US)

(72) Inventor: Tracey Ponder, Dayton, TX (US)

(73) Assignee: WILD BUCKS OUTDOORS, LLC, Dayton, TX (US)

( * ) Notice: Subject to any disclaimer, the term of this patent is extended or adjusted under 35 U.S.C. 154(b) by 136 days.

(21) Appl. No.: 14/624,306

(22) Filed: Feb. 17, 2015

(65) Prior Publication Data

US 2015/0233669 A1 Aug. 20, 2015

Related U.S. Application Data

(60) Provisional application No. 61/941,412, filed on Feb. 18, 2014.

(51) Int. Cl.
*F41C 33/00* (2006.01)

(52) U.S. Cl.
CPC ..... *F41C 33/007* (2013.01); *F41C 33/001* (2013.01)

(58) Field of Classification Search
CPC ..... F41C 33/027; F41C 33/046; F41C 33/02; F41C 33/007; A47B 81/005; A01K 97/04
USPC ..... 224/271, 196, 199, 907, 913
See application file for complete search history.

(56) References Cited

U.S. PATENT DOCUMENTS

| | | | | |
|---|---|---|---|---|
| 2,504,125 A | | 4/1950 | Hight | |
| 3,501,074 A | * | 3/1970 | Emerick | F41C 33/007 224/246 |
| 3,747,167 A | | 7/1973 | Pravaz | |
| 5,642,847 A | | 7/1997 | DeMeo et al. | |
| 6,161,741 A | * | 12/2000 | French | F41C 33/045 224/192 |
| 6,336,576 B1 | | 1/2002 | Easter | |
| 6,786,372 B2 | * | 9/2004 | Enkerlin | A45F 5/02 224/196 |
| 7,162,281 B2 | * | 1/2007 | Kim | A45F 5/02 224/196 |
| 7,690,541 B2 | * | 4/2010 | Pellegrini | A45F 5/02 224/197 |

(Continued)

OTHER PUBLICATIONS

PCT International Search Report and Written Opinion of the International Searching Authority for PCT/US2015/016277, dated May 20, 2015.

*Primary Examiner* — Brian D Nash
(74) *Attorney, Agent, or Firm* — Kenneth A. Roddy

(57) ABSTRACT

An assembly is disclosed. The assembly includes a base portion and a selectively rotatable portion attached to the base portion. The base portion includes a first subassembly attached to a second subassembly. The first subassembly includes a housing that at least partially contains an actuator. The second subassembly includes a housing receiver that retains the housing. The selectively rotatable portion includes an indexing member attached to an implement carrier portion. The actuator of the base portion is selectively interfaced with the indexing member of the selectively rotatable portion in order to permit the selectively rotatable portion to be arranged relative the base portion in one of two orientations being a rotatably-locked orientation and a freely rotatable orientation.

20 Claims, 34 Drawing Sheets

(56) References Cited

U.S. PATENT DOCUMENTS

| | | | | |
|---|---|---|---|---|
| 8,517,234 | B2 * | 8/2013 | Kincaid | F41C 33/045 224/192 |
| 8,783,532 | B2 * | 7/2014 | Gregory | F41C 33/045 224/198 |
| 9,243,867 | B2 * | 1/2016 | Ponder | F41C 33/007 |
| 2006/0196903 | A1 * | 9/2006 | Tanzini | F41C 33/0209 224/200 |
| 2007/0023468 | A1 | 2/2007 | Ford | |
| 2011/0094006 | A1 | 4/2011 | Cole et al. | |
| 2012/0266352 | A1 | 10/2012 | Busch | |
| 2013/0146628 | A1 | 6/2013 | Gump | |

* cited by examiner

HANDS-FREE SUPPORT DEVICE, A SUBASSEMBLY OF A HANDS-FREE SUPPORT DEVICE AND METHODS FOR OPERATING THE SAME

CROSS-REFERENCE TO RELATED APPLICATION

This U.S. patent application claims priority to U.S. Provisional Application 61/941,412, filed on Feb. 18, 2014.

TECHNICAL FIELD

This disclosure relates to a hands-free support device, a subassembly of a hands-free support device and methods for operating the same.

BACKGROUND

Support devices that are secured to a person are known in the art. While known support devices have proven to be acceptable for various applications, such conventional support devices are nevertheless susceptible to improvements that may enhance their overall performance and cost. Therefore, a need exists to develop improved support devices and methodologies for utilizing the same that advance the art.

SUMMARY

An assembly is provided and includes a selectively rotatable portion attached to the base portion. The base portion includes a first subassembly attached to a second subassembly. The first subassembly includes a housing that at least partially contains an actuator. The second subassembly includes a housing receiver that retains the housing. The selectively rotatable portion includes an indexing member attached to an implement carrier portion. The actuator of the base portion is selectively interfaced with the indexing member of the selectively rotatable portion in order to permit the selectively rotatable portion to be arranged relative the base portion in one of two orientations being a rotatably-locked orientation and a freely rotatable orientation.

In one configuration, the assembly additionally includes a quick-deployment implement retainer portion attached to the selectively rotatable portion.

In one configuration, the quick-deployment implement retainer portion includes a substantially planar body of foldable material, at least one distal strap portion and at least one proximal strap portion. The at least one distal strap portion is attached to a distal end of the substantially planar body of foldable material. The at least one proximal strap portion is attached to a proximal end of the substantially planar body of foldable material. The at least one distal strap portion attaches the quick-deployment implement retainer portion to the selectively rotatable portion. The at least one proximal strap portion is selectively attachable to the at least one distal strap portion in order to arrange the substantially planar body of foldable material in one of two positions being an open orientation and a closed orientation.

In one configuration, the quick-deployment implement retainer portion further includes at least one buckle member and a quick-release actuator. The at least one buckle member attaches the at least one proximal strap portion to the proximal end of the substantially planar body of foldable material. The quick-release actuator is attached to the at least one buckle member to permit selective detaching of a male portion from a female portion of the at least one buckle member for transitioning the substantially planar body of foldable material from the closed orientation to the deployed orientation.

In one configuration, the quick-deployment implement retainer portion removably contains an implement.

In one configuration, the implement is a firearm.

In one configuration, the assembly also includes an article of clothing attached to the base portion.

In one configuration, the article of clothing is a vest.

In one configuration, the assembly includes a harness attached to the base portion.

A hands-free support device assembly is provided and includes a first subassembly attached to a second subassembly. The first subassembly includes a housing, a locking pin, a spring member and a retaining washer. The housing defines an axial passage and a radial passage that intersects with and is in fluid communication with the axial passage. The locking pin is at least partially disposed within the radial passage. The locking pin includes a collar portion that separates a length of the locking pin into a distal portion and proximal portion. A spring member circumscribes the locking pin and is disposed within the radial passage. The spring member includes a distal end and a proximal end. The distal end of the spring member is disposed against a proximal shoulder surface of the collar portion of the locking pin. The retaining washer is disposed within the radial passage for removably-securing the locking pin and spring member within the radial passage. A distal surface of the retaining washer is disposed against the proximal end of the spring member thereby compressing the spring member between the proximal shoulder surface of the locking pin and the distal surface of the retaining washer. The second subassembly includes a housing receiver and one or more fasteners. The housing is disposed within the housing receiver. The one or more fasteners attaches the housing receiver to the housing.

In one configuration, compression of the spring member between the proximal shoulder surface of the collar portion of the locking pin and the distal surface of the retaining washer results in the spring member radially biasing the locking pin in a direction toward the axial passage of the housing for arranging a portion of a length of the distal portion of the locking pin within the axial passage.

In one configuration, the radial passage is defined by a non-constant diameter having a first shoulder surface and a second shoulder surface. A distal shoulder surface of the collar portion of the locking pin is disposed against the first shoulder surface defining the radial passage. The distal surface of the retaining washer is disposed against the second shoulder surface defining the radial passage.

In one configuration, the retaining washer defines a passage that permits a portion of a length of the proximal portion of the locking pin to extend through the retaining washer such that the portion of the length of the proximal portion of the locking pin extends beyond an outer side surface of the housing.

In one configuration, the assembly additionally includes an actuator connected to the length of the proximal portion of the locking pin that extends beyond an outer side surface of the housing.

In one configuration, the assembly additional includes one of more alignment keys extending from the axial passage.

An assembly is provided and includes a selectively rotatable portion that includes an implement carrier portion and an indexing member. The indexing member is connected to the implement carrier portion by one or more fasteners. The indexing member is inserted through an opening formed by a housing receiver of a base portion and an axial passage extending through the housing. A locking pin (20) of the base portion is selectively-interfaced with the indexing member for selectively rotatably-joining the selectively rotatable portion to the base portion.

In one configuration, the indexing member includes a substantially cylindrical body having a front surface, a rear surface and a substantially circumferential side surface. The substantially circumferential side surface defines a recessed circumferential channel and alignment key channels that are in fluid communication with the recessed circumferential channel. The alignment key channels extend from the rear surface of the indexing member. One of more alignment keys of the base portion are arranged within the recessed circumferential channel by way of the alignment key channels.

In one configuration, the recessed circumferential channel further defines a plurality of locking pin receiving passages. A portion of a length of the distal portion of the locking pin is selectively-disposed in a locking pin receiving passage of the plurality of locking pin receiving passages for selectively rotatably-joining the selectively rotatable portion to the base portion.

In one configuration, the assembly additional includes a quick-deployment implement retainer portion attached to the selectively rotatable portion.

In one configuration, the quick-deployment implement retainer portion further includes a substantially planar body of foldable material, at least one distal strap portion and at least one proximal strap portion. The at least one distal strap portion is attached to a distal end of the substantially planar body of foldable material. The at least one proximal strap portion is attached to a proximal end of the substantially planar body of foldable material. The at least one distal strap portion attaches the quick-deployment implement retainer portion to the selectively rotatable portion. The at least one proximal strap portion is selectively attachable to the at least one distal strap portion in order to arrange the substantially planar body of foldable material in one of two positions being an open orientation and a closed orientation.

In one configuration, the quick-deployment implement retainer portion additionally includes at least one buckle member and a quick-release actuator. The at least one buckle member attaches the at least one proximal strap portion to the proximal end of the substantially planar body of foldable material. The quick-release actuator is attached to the at least one buckle member to permit selective detaching of a male portion from a female portion of the at least one buckle member for transitioning the substantially planar body of foldable material from the closed orientation to the deployed orientation.

In another configuration, a method is provided and includes arranging a selectively rotatable portion relative a base portion in a first selectively rotatably-locked orientation; actuating an actuator for selectively rotatably-unlocking the selectively rotatable portion from the base portion; rotating the selectively rotatable portion relative the base portion; after rotating the selectively rotatable portion relative the base portion, releasing the actuator for arranging the selectively rotatable portion relative the base portion in a second selectively rotatably-locked orientation that is different than the first selectively rotatably-locked orientation.

In one configuration, the method may additionally include securing a quick-deployment implement retainer portion to the selectively rotatable portion; removably-securing an implement within the quick-deployment implement retainer portion; and actuating a quick-release actuator for transitioning the quick-deployment implement retainer portion from: a closed orientation to a deployed orientation for selectively-releasing the implement from the quick-deployment implement retainer portion.

In another configuration, a method is provided and includes securing a selectively rotatable portion to a base portion; securing a quick-deployment implement retainer portion to the selectively rotatable portion; actuating one of a first actuator and a second actuator for: rotatably-unlocking the selectively rotatable portion from the base portion; and transitioning the quick-deployment implement retainer portion from: a closed orientation to a deployed orientation.

In one configuration, the method may additionally include after rotatably-unlocking the selectively rotatable portion from the base portion, releasing the actuator for arranging the selectively rotatable portion relative the base portion in a selectively rotated and locked orientation.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

An exemplary hands-free support device is described in the following disclosure. The hands-free support device may support any desirable implement including but not limited to, for example, a firearm, F (see, e.g., FIGS. 19A-19G, 20 and 22A-22C). The hands-free support device may be removably-secured to an operator (e.g., a hunter, law enforcement personnel, military personnel or the like) such that the operator wears the hands-free support device on his/her person. Once the hands-free support device is secured to the operator, the operator may removably-secure the firearm, F, to a first portion of the hands-free support device (see, e.g., FIGS. 19A-19C). When the firearm, F, is removably-secured to the hands-free support device, the operator may carry the firearm, F, without using his/her hands. The operator may engage a first actuator (see, e.g., FIG. 19C) of the hands-free support device in order to selectively permit rotation (see, e.g., FIG. 19D) of the first portion of the hands-free support device (and the firearm, F, supported thereupon) relative a fixed orientation of a second portion of the hands-free support device. Upon disengaging the first actuator (see, e.g., FIG. 19E), the first portion of the hands-free support device (and firearm, F, supported thereupon) may retain a selectively-rotated-and-locked orientation of the first portion of the hands-free support device (and the firearm, F, supported thereupon) relative to the second portion of the hands-free support device. Furthermore, the operator may actuate a second actuator (see, e.g., FIG. 19F) of the hands-free support device in order to permit the firearm, F, to be selectively and quickly deployed (see, e.g., FIG. 19G) from the first portion of the hands-free support device.

Referring to FIGS. 1A-1F, an exemplary hands-free support device is shown generally at 10. The hands-free support device 10 includes a base portion 12, a selectively rotatable portion 14 and a quick-deployment implement retainer portion 16.

As seen in FIGS. 19A-19G and 22A-22C, the base portion 12 may be secured to an article of clothing, such as, for example, a vest (e.g., a modular lightweight load-carrying equipment (MOLLE) vest). As seen in FIGS. 20-21B, the base portion 12 may alternatively be secured to harness, one or more strap members or the like. The article of clothing, harness, one or more strap members or the like may be arranged upon the person of an operator.

Figure 1A:
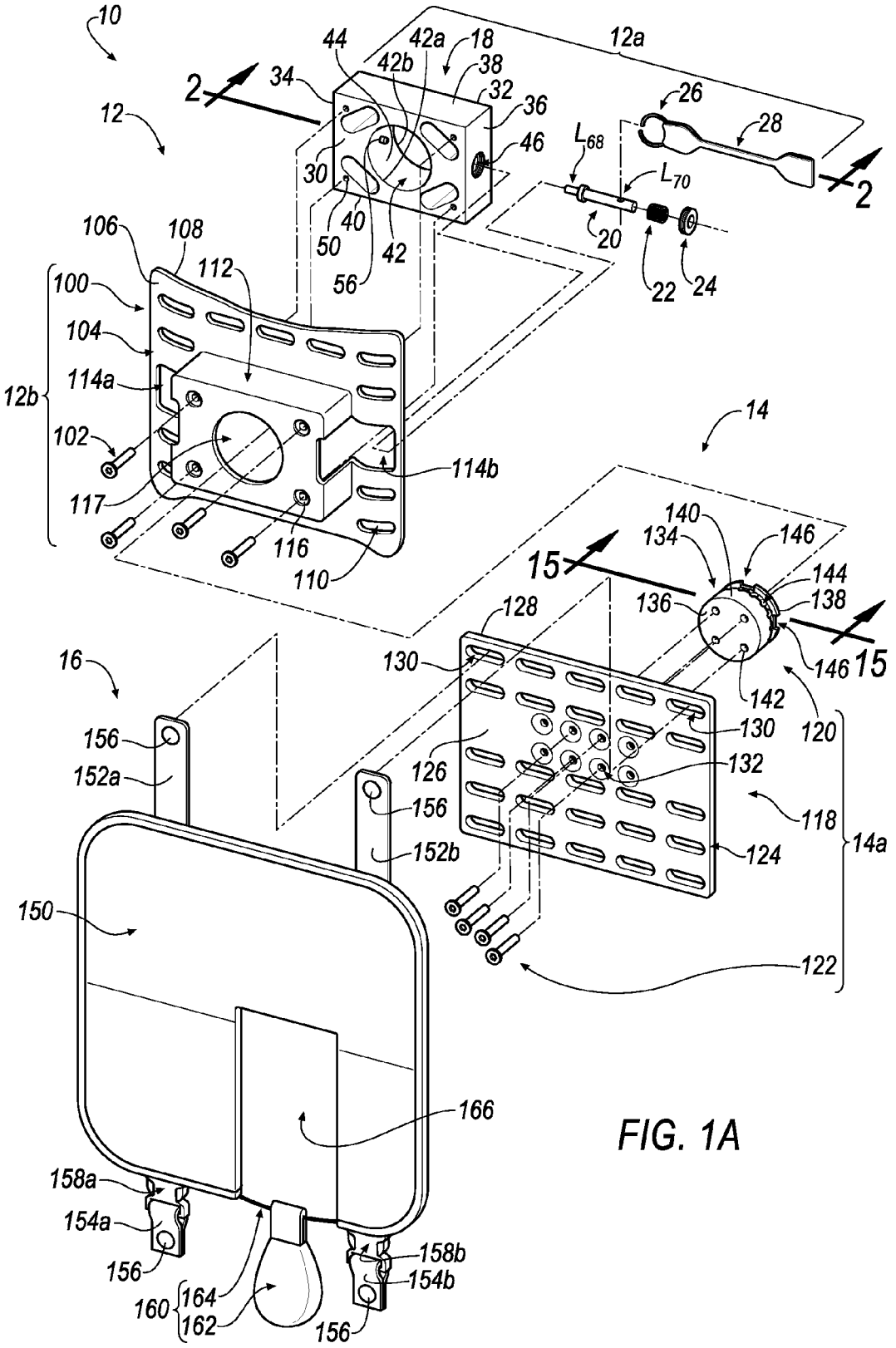
FIG. 1A is an exploded perspective view of an exemplary hands-free support device.
Figure 1B:
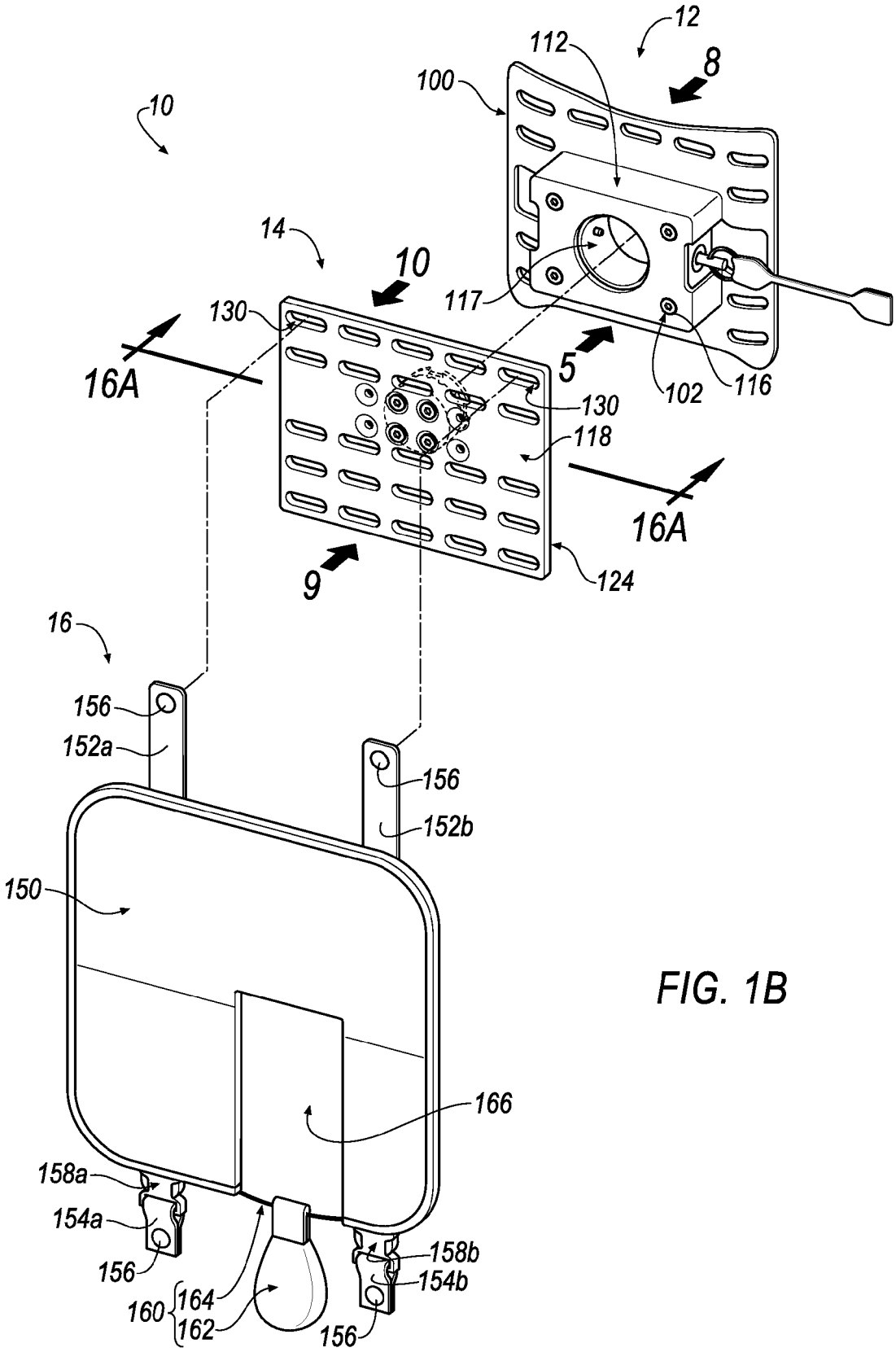
FIG. 1B is a partially exploded perspective view of the hands-free support device of FIG. 1A, illustrating the hands-free support device in a partially assembled orientation.
Figure 1C:
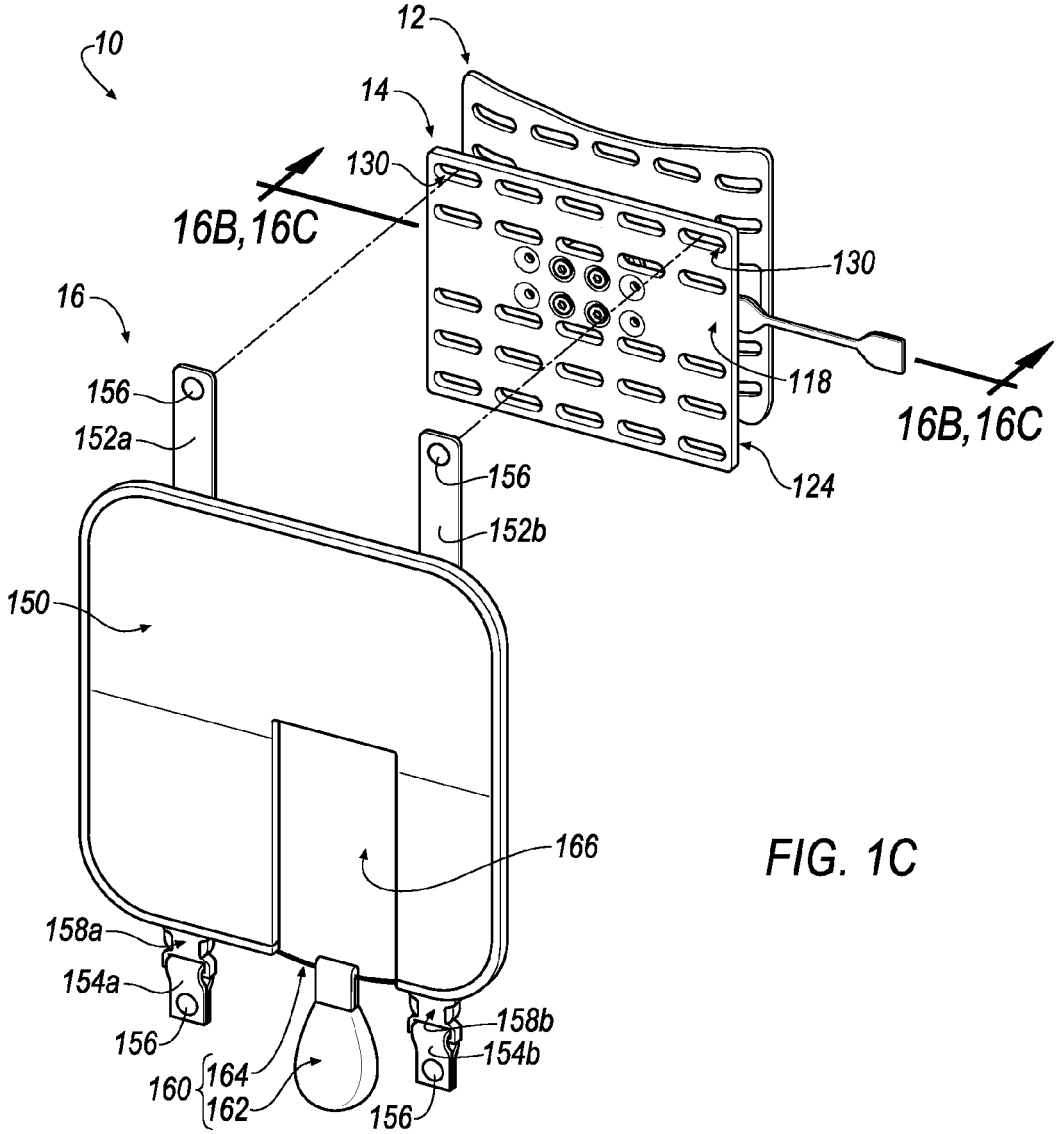
FIG. 1C is another partially exploded perspective view of the hands-free support device of FIG. 1A, illustrating the hands-free support device in a partially assembled orientation.
Figure 1D:
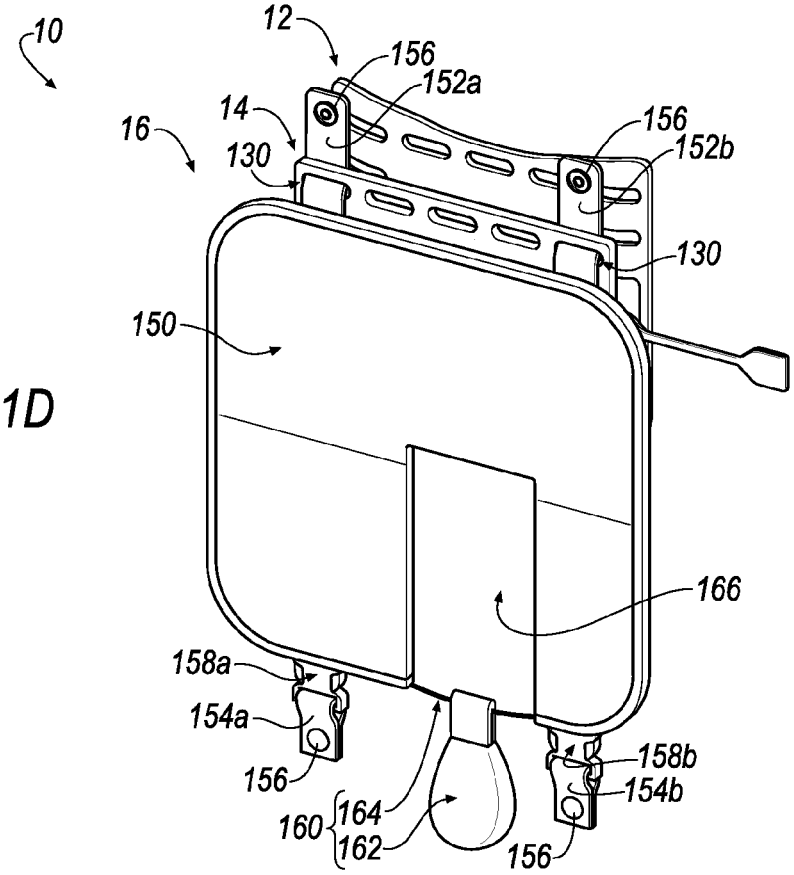
FIG. 1D is a perspective view of the hands-free support device of FIG. 1A, illustrating the hands-free support device in an open orientation.

As seen in FIGS. 1B-1C, the selectively rotatable portion 14 is selectively removably attached to the base portion 12. As seen in FIGS. 1C-1D, the quick-deployment implement retainer portion 16 is selectively removably attached to the selectively rotatable portion 14.

The quick-deployment implement retainer portion 16 may be arranged in an open orientation (see, e.g., FIG. 1D) in order to permit receipt of, e.g., an implement (such as, e.g., a firearm, F) thereupon. The quick-deployment implement retainer portion 16 may also be arranged in a closed orientation (see, e.g., FIG. 1E) in order to, e.g., removably-secure the implement (such as, e.g., a firearm, F) thereto. The quick-deployment implement retainer portion 16 may even further be arranged in a deployed orientation (see, e.g., FIG. 1F) in order to permit the implement (such as, e.g., a firearm, F) to be quickly deployed/removed from the quick-deployment implement retainer portion 16.

Referring to FIGS. 1A and 2-4, a first subassembly of the base portion 12 is shown generally at 12*a*. The first subassembly 12*a* may include but is not limited to including: a housing 18, a locking pin 20, a spring member 22, a retaining washer 24, a ring 26 and an actuator 28.

As seen in FIG. 1A, the housing 18 includes a front surface 30, a rear surface 32, a left side surface 34, a right side surface 36, an upper surface 38 and a lower surface 40. An axial passage 42 extends through the housing 18 from the front surface 30 to the rear surface 32. The axial passage 42 may be defined by an axial passage surface 44 and a diameter $D_{42}$ (see, e.g., FIG. 2). Access to the axial passage 42 is permitted by a first opening 42*a* formed by the front surface 30 of the housing 18 and a second opening 42*b* formed by the rear surface 32 of the housing 18.

Figure 2:
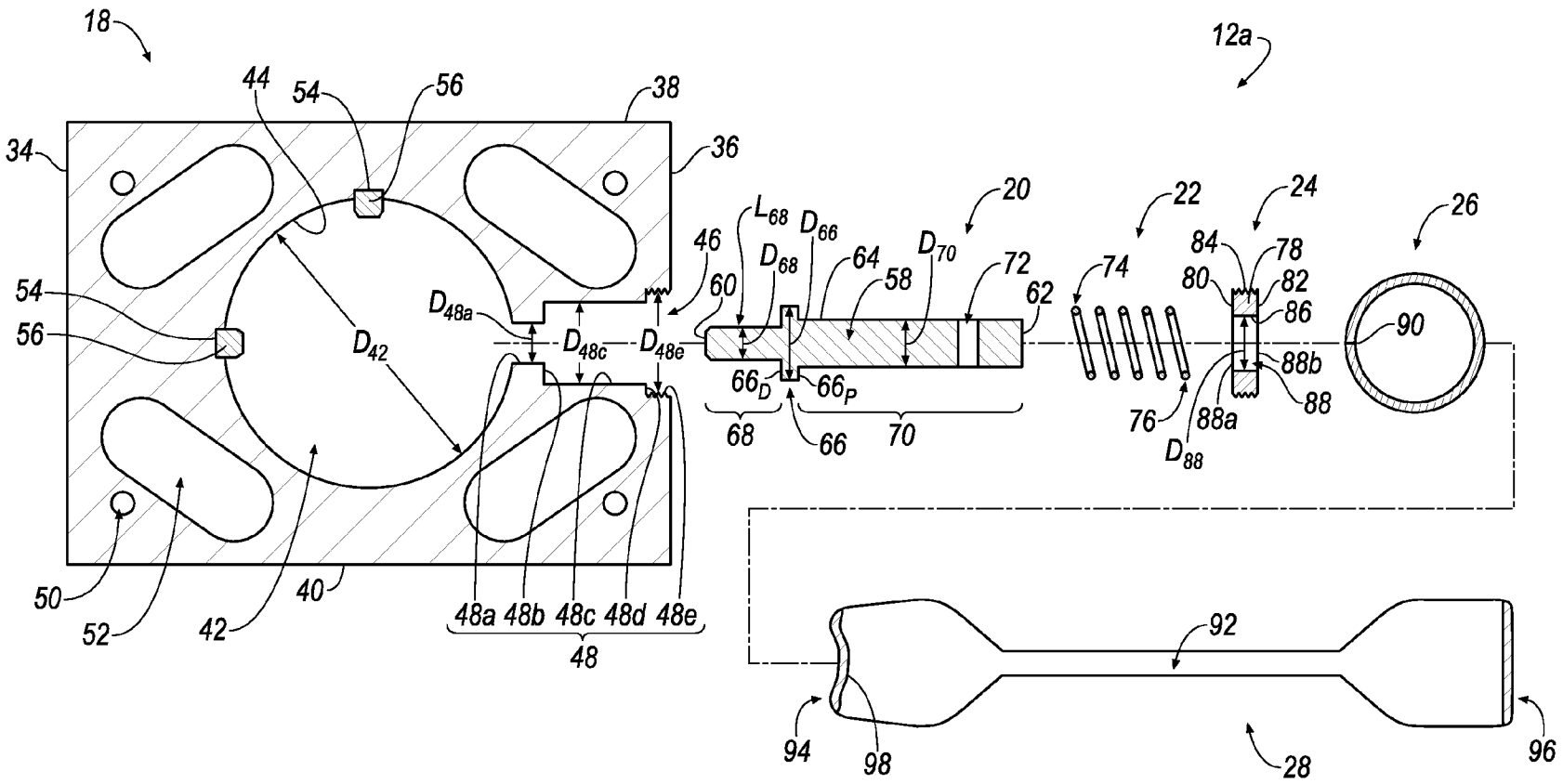
FIG. 2 is a cross-sectional view of a first subassembly of a base portion of the hands-free support device according to line 2-2 of FIG. 1A.

Referring to FIGS. 1A and 2, a radial passage 46 extends into one of the left side surface 34, the right side surface 36, the upper surface 38 or the lower surface 40 of the housing 12. Without limitation, the radial passage 46 is illustrated extending into the right side surface 36 of the housing 12. In an example, the radial passage 46 extends into the housing 12 from the right side surface 36 to the axial passage surface 44 such that the radial passage 46 is in fluid communication with the axial passage 42.

As seen in FIG. 2, the radial passage 46 is defined by a radial passage surface 48. The radial passage surface 48 is defined by a first radial passage surface portion 48*a*, a second radial passage surface portion 48*b*, a third radial passage surface portion 48*c*, a fourth radial passage surface portion 48*d* and a fifth radial passage surface portion 48*e*. The first radial passage surface portion 48*a* is connected to the axial passage surface 44. The second radial passage surface portion 48*b* is a first shoulder surface that connects the first radial passage surface portion 48*a* to the third radial passage surface portion 48*c*. The fourth radial passage surface portion 48*d* is a second shoulder surface that connects the third radial passage surface portion 48*c* to the fifth radial passage surface portion 48*e*. The right side surface 36 is connected to the fifth radial passage surface portion 48*e*. The fifth radial passage surface portion 48*e* may define a threaded surface.

The radial passage 46 may be defined by a non-constant diameter. The first radial passage surface portion 48*a* of the radial passage surface 48 defines the radial passage 46 to include a first diameter $D_{48a}$. The third radial passage surface portion 48*c* of the radial passage surface 48 defines the radial passage 46 to include a second diameter $D_{48c}$ that is greater than the first diameter $D_{48a}$. The fifth radial passage surface portion 48*e* of the radial passage surface 48 defines the radial passage 46 to include a third diameter $D_{48e}$ that is greater than second diameter $D_{48c}$.

Figure 3:
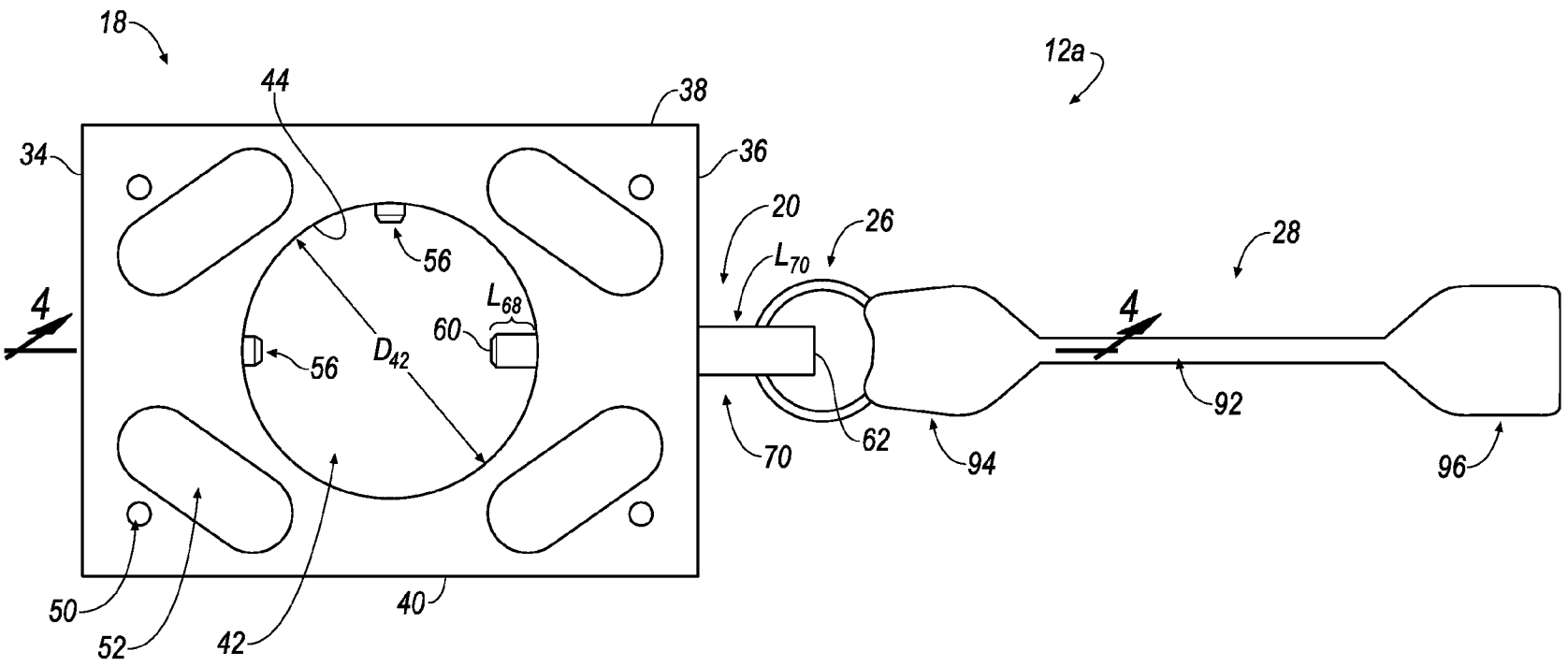
FIG. 3 is a front, assembled view of the first subassembly of the base portion of FIG. 2.
Figure 4:
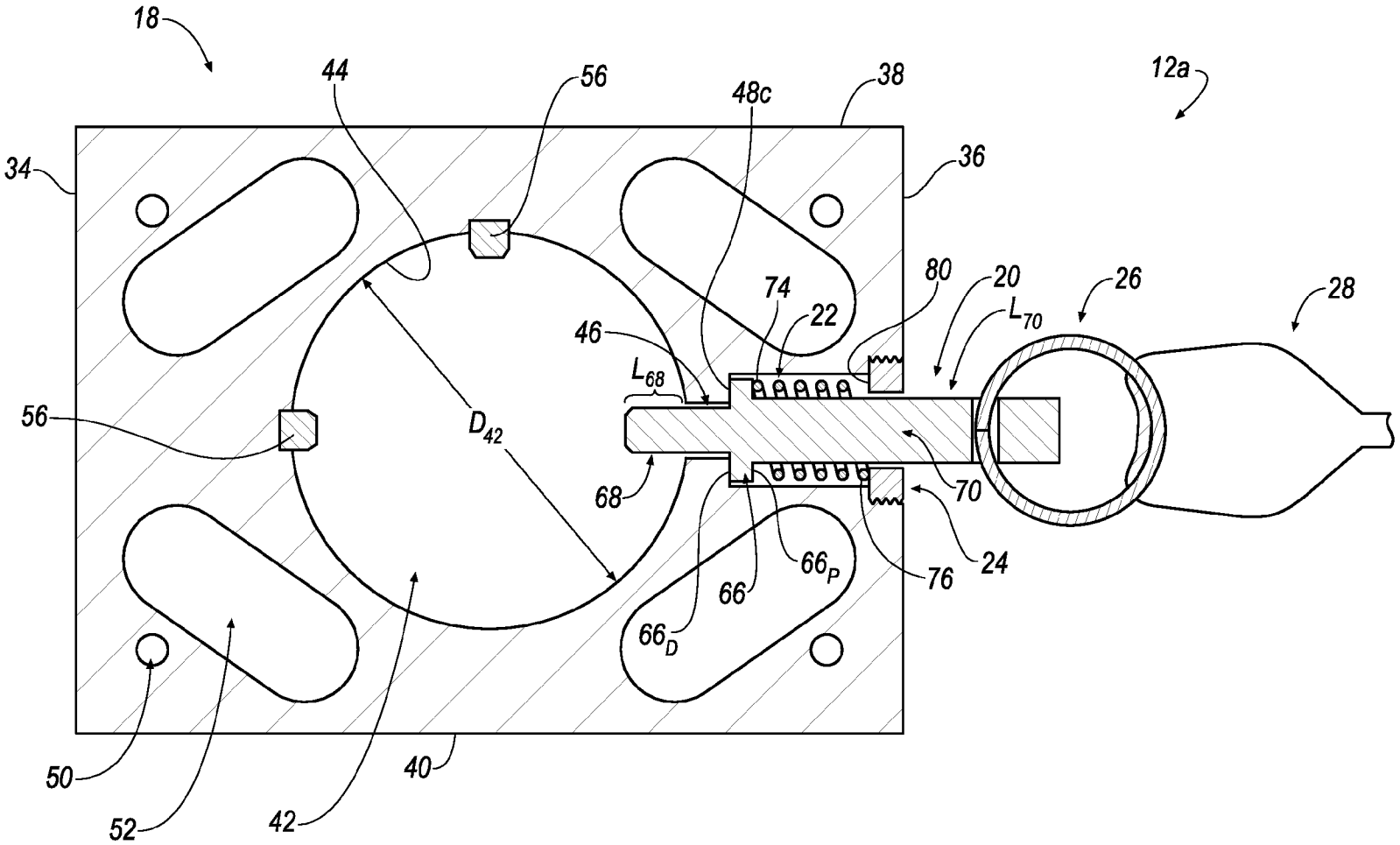
FIG. 4 is a cross-sectional view of the first subassembly of the base portion according to line 4-4 of FIG. 3.
Figure 6:
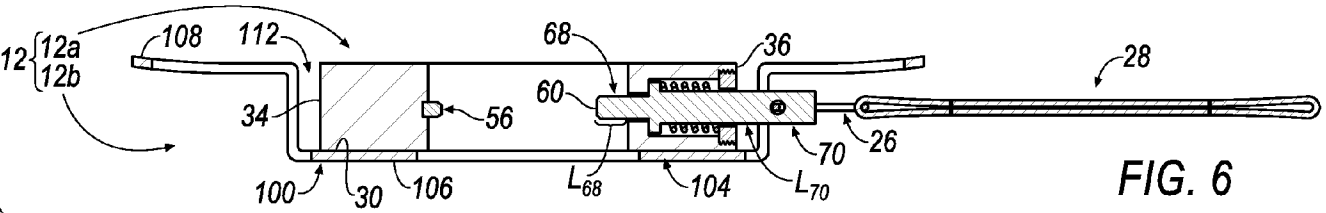
FIG. 6 is a cross-sectional view of the base portion of the hands-free support device according to line 6-6 of FIG. 5.
Figure 5:
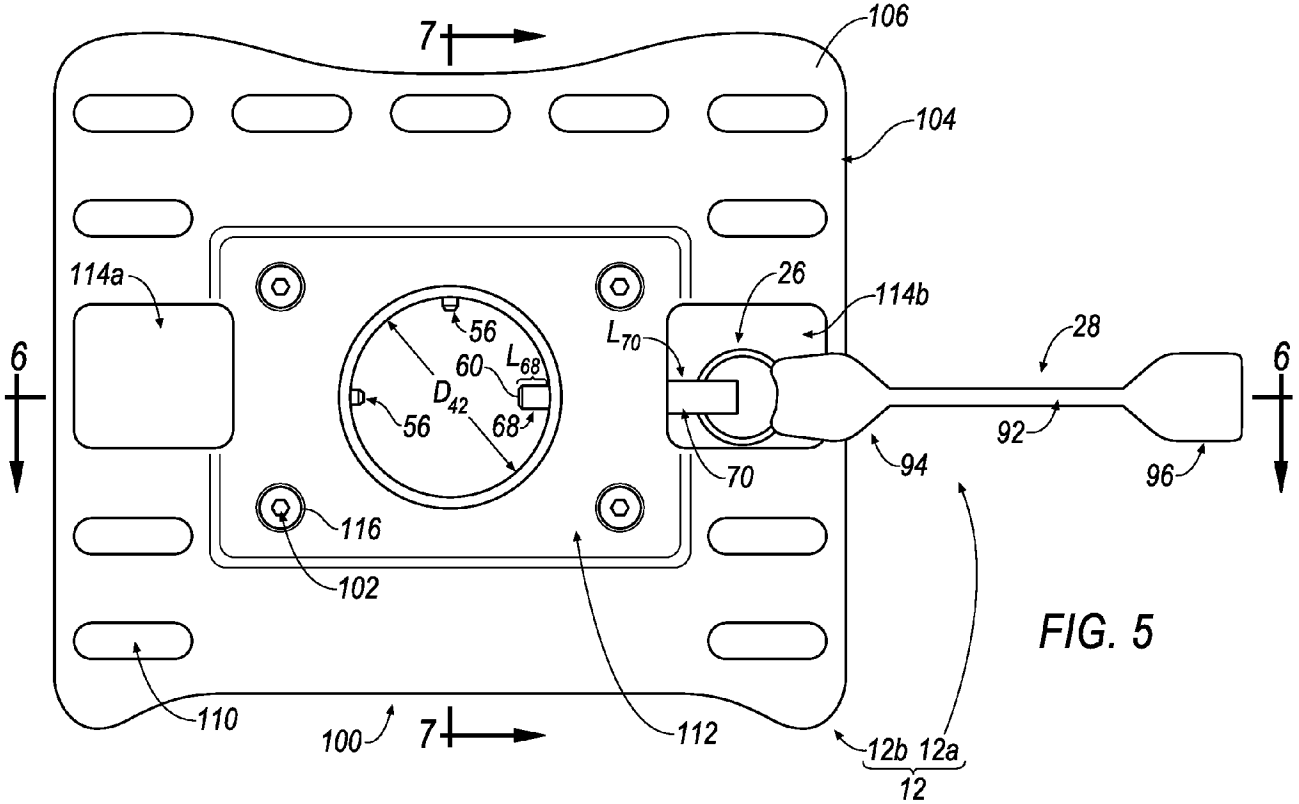
FIG. 5 is a front, assembled view of the base portion of the hands-free support device according to arrow 5 of FIG. 1B.
Figure 7:
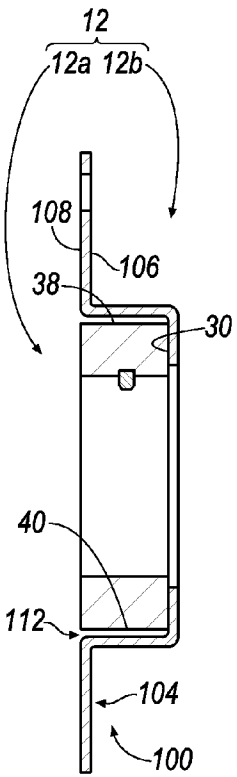
FIG. 7 is a cross-sectional view of the base portion of the hands-free support device according to line 7-7 of FIG. 5.
Figure 8:
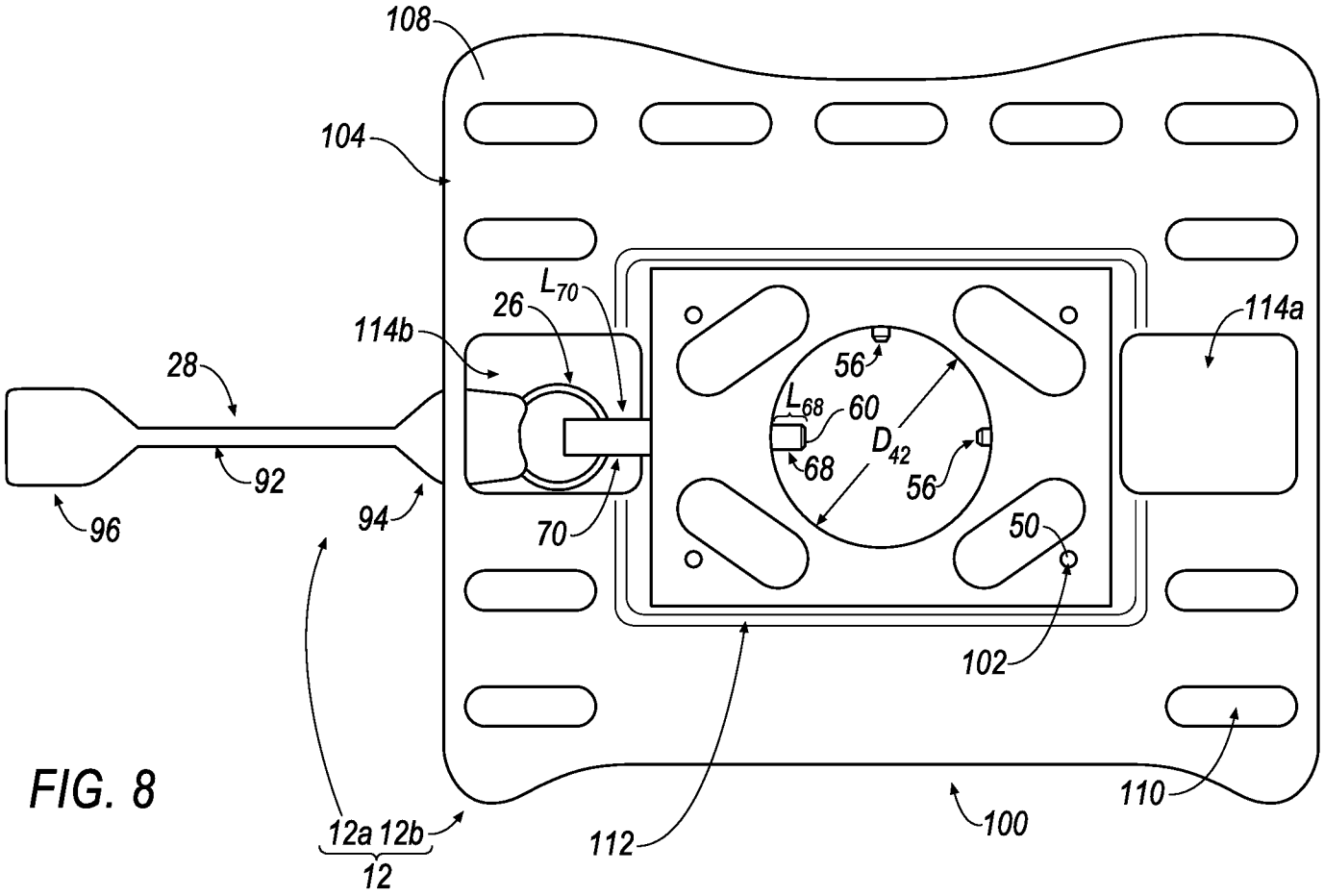
FIG. 8 is a rear, assembled view of the base portion of the hands-free support device according to arrow 8 of FIG. 1B.
Figure 9:
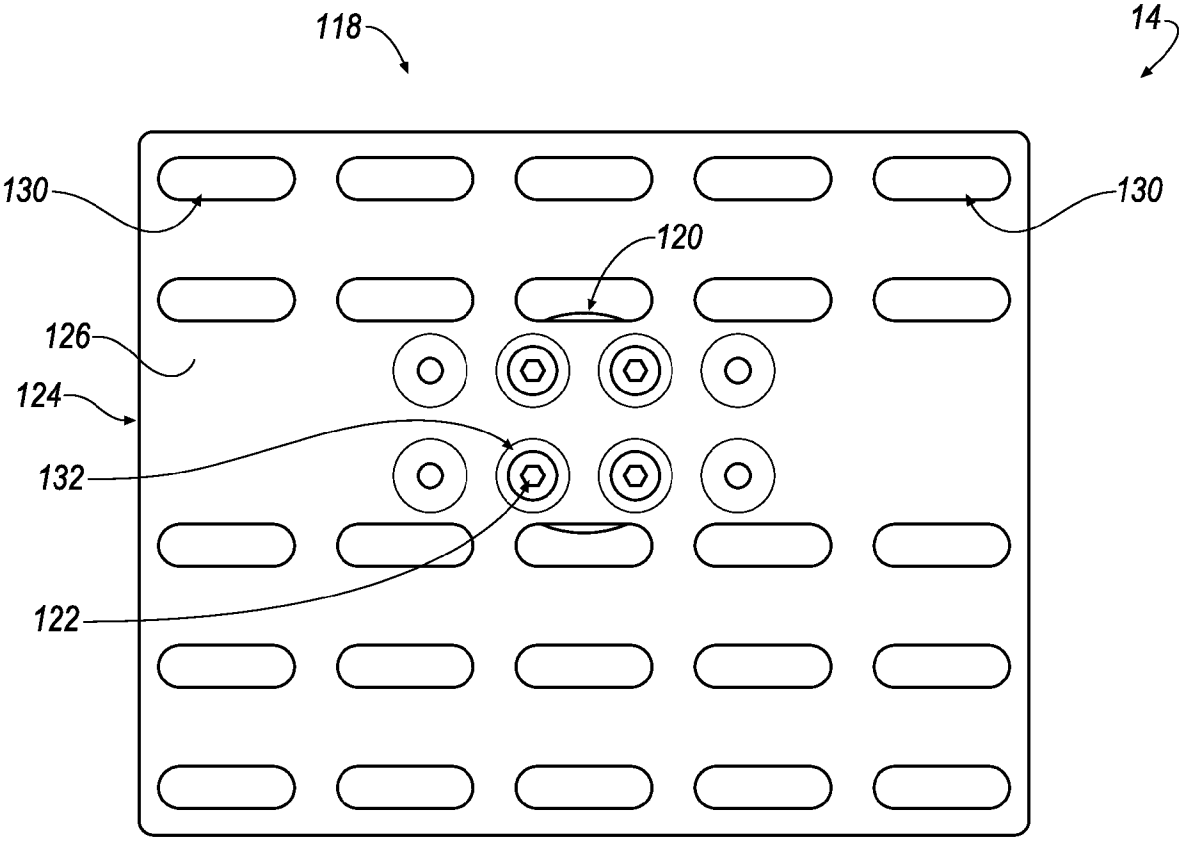
FIG. 9 is a front, assembled view of a selectively rotatable portion of the hands-free support device according to arrow 9 of FIG. 1B.
Figure 11:
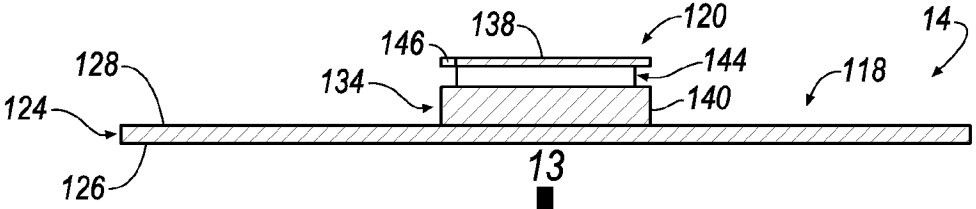
FIG. 11 is a cross-sectional view of the selectively rotatable portion of the hands-free support device according to line 11-11 of FIG. 10.
Figure 10:
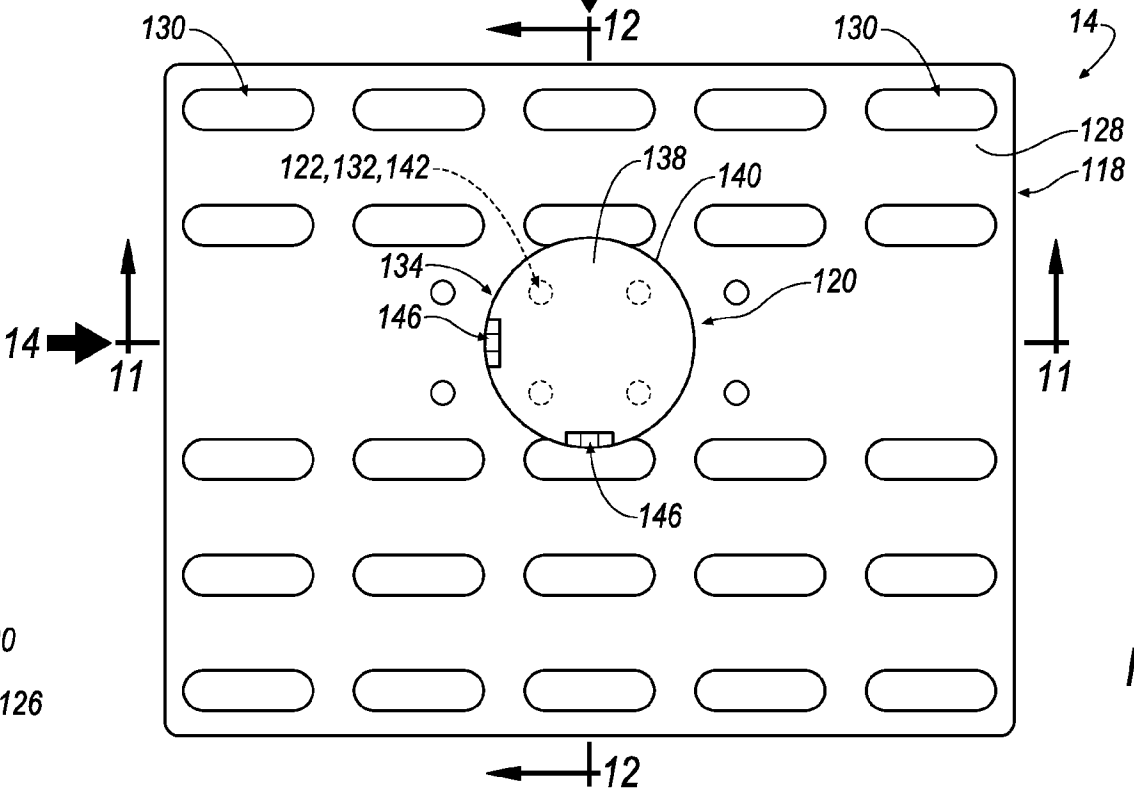
FIG. 10 is a rear, assembled view of a selectively rotatable portion of the hands-free support device according to arrow 10 of FIG. 1B.
Figure 12:
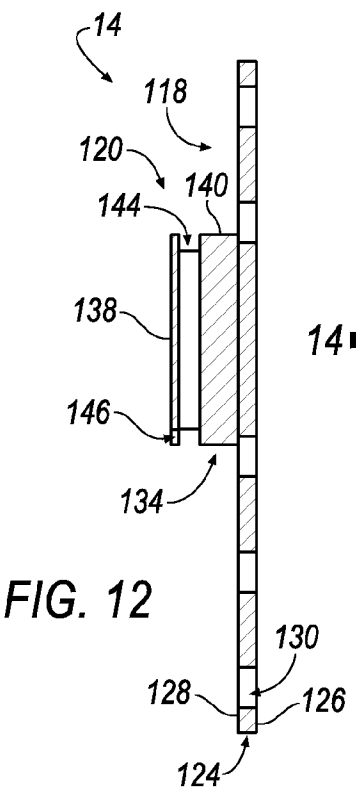
FIG. 12 is a cross-sectional view of the selectively rotatable portion of the hands-free support device according to line 12-12 of FIG. 10.

Referring to FIGS. 2-4, the housing 18 may also define a plurality of fastener-receiving passages 50. The housing 18 may further define a plurality of relief passages 52. The plurality of relief passages 52 may reduce the weight, amount of material and cost associated with the manufacturing of the housing 18.

Referring to FIG. 2, the axial passage surface 44 that defines the axial passage 42 may define one or more alignment key cavities 54 for respectively receiving one of more alignment keys 56. One of the alignment keys 56 may be angularly offset from the radial passage 46 by approximately 90°. One of the alignment keys 56 may be angularly offset from the radial passage 46 by approximately 180°. The alignment keys 56 may be angularly offset from one another by approximately 90°. The function of the alignment keys will be described in greater detail in the following disclosure.

Referring to FIG. 2, the locking pin 20 is define by a substantially cylindrical body 58 having a distal end surface 60, a proximal end surface 62 and a side surface 64 connecting the distal end surface 60 to the proximal end surface 62. A collar portion 66 extends radially outwardly from the side surface 64 of the substantially cylindrical body 58 and separates the locking pin 20 into a distal portion 68 and a proximal portion 70. A portion of the side surface 64 defining the collar portion 66 may include a distal shoulder surface $\mathbf{66}_D$ and a proximal shoulder surface $\mathbf{66}_P$.

The side surface 64 of the substantially cylindrical body 58 defines the locking pin 20 to have a non-constant diameter. For example, the outer side surface 64 defines the distal portion 68 of the locking pin 20 to include a first diameter $D_{68}$. The outer side surface 64 defines the proximal portion 70 of the locking pin 20 to include a second diameter $D_{70}$ that is greater than the first diameter $D_{68}$. The outer side surface 64 defines the collar portion 66 of the locking pin 20 to include a third diameter $D_{66}$ that is greater than second diameter $D_{70}$.

A radial passage 72 may also extend through the proximal portion 70 of the locking pin 20. As will be explained in the following disclosure, the ring 26 may be extended through the radial passage 72 for connecting the locking pin 20 to the actuator 28.

As seen in FIG. 2, the spring member 22 may be a coil spring. The spring member 22 may include a distal end 74 and a proximal end 76.

Referring to FIG. 2, the retaining washer 24 defines a tube-shaped body 78 having a distal surface 80, a proximal surface 82 and an outer side surface 84 connecting the distal surface 80 to the proximal surface 82. The outer side surface 84 is a threaded surface.

The retaining washer 24 also includes an inner side surface 86 that defines a passage 88 extending through the retaining washer 24 from the distal surface 80 to the proximal surface 82. The inner side surface 86 also connects the distal side surface 80 to the proximal surface 82. Access to the passage 88 is permitted by a first opening 88*a* formed by the distal surface 80 and a second opening 88*b* formed by the proximal surface 82. The inner side surface 86 defines the passage 88 to include a diameter, $D_{88}$.

As seen in FIG. 2, the ring 26 may be a substantially circular member. The ring 26 may include a break 90 in order to permit the ring 26 to be attached to each of the locking pin 20 and the actuator 28.

Referring to FIG. 2, the actuator 28 may include an elongated body 92 having a distal end 94 and a proximal end 96. The distal end 94 may define a radial passage 98 extending radially through the elongated body 92. The ring 26 may be extended through the radial passage 98 for connecting the actuator 28 to the locking pin 20.

An exemplary method for assembling the first subassembly 12*a* is now described. The locking pin 20 may be sized for receipt within the radial passage 46 of the housing 18. For example, the non-constant diameters $D_{48a}$ and $D_{48c}$ defining a portion of the radial passage 46 are approximately equal to but slightly greater than the diameters $D_{68}$ and $D_{66}$ defining the distal portion 68 and the collar portion 66 of the locking pin 20. Therefore, as a result: (1) the distal portion 68 of the locking pin 20 may be sized for receipt within the radial passage 46 as defined by the diameter, $D_{48a}$ and (2) the collar portion 66 of the locking pin 20 may be sized for receipt within the radial passage 46 as defined by the diameter, $D_{48c}$.

The first subassembly 12*a* may be assembled by firstly axially aligning the distal portion 68 of the locking pin 20 with the radial passage 46 of the housing 18. The locking pin 20 is then inserted into the radial passage 46 of the housing 18 until distal shoulder surface $\mathbf{66}_D$ of the collar portion 66 of the locking pin 20 is disposed adjacent the second radial passage surface portion 48*b*/first shoulder surface of the radial passage surface 48. Once the distal shoulder surface $\mathbf{66}_D$ of the collar portion 66 is disposed adjacent the second radial passage surface portion 48*b*/first shoulder surface of the radial passage surface 48, a portion of the length $L_{68}$ of the distal portion 68 of the locking pin 20 extending away from the distal end surface 60 of the locking pin 20 may be arranged within the axial passage 42 that extends through the housing 18.

Next, the spring member 22 may be axially aligned with the radial passage 46 and axially moved relative the locking pin 20 (that is arranged within the radial passage 46) in a direction from the proximal end surface 62 of the locking pin 20 toward the distal end surface 60 of the locking pin 20 such that the spring member 22 may circumscribe the outer side surface 64 of the substantially cylindrical body 58 of the locking pin 20 as defined by the proximal portion 70 of the locking pin 20. Furthermore, axial movement of the spring member 22 results in the spring member 22 being at least partially arranged within the radial passage 46 and between the outer side surface 64 of the substantially cylindrical body 58 of the locking pin 20 and the third radial passage surface portion 48*c* of the radial passage surface 48 defining the radial passage 46. Axial movement of the spring member 22 relative the locking pin 20 is ceased once the distal end 74 of the spring member 22 is disposed adjacent the proximal shoulder surface 66*p* of the collar portion 66.

Next, the retaining washer 24 may be axially aligned with the radial passage 46 and axially moved toward the proximal end 76 of the spring member 24. Prior to threadingly engaging the threaded surface defining the outer side surface 84 of the retaining washer 24 with the threaded surface defining the fifth radial passage surface portion 48*e* of the radial passage surface 48 defining the radial passage 46, movement of the retaining washer 24 relative the locking pin 20 permits the proximal end surface 62 of the locking pin 20 to pass through the passage 88 of the retaining washer 24 by way of the first opening 88*a* formed by the distal surface 80 of the retaining washer 24. As the retaining washer 24 is further axially moved toward the radial passage 46, the proximal end surface 62 of the locking pin 20 subsequently passes through the second opening 88*b* formed by the proximal surface 82 of the retaining washer 24.

As the retaining washer 24 is further axially moved toward the radial passage 46, the threaded surface defining the outer side surface 84 of the retaining washer 24 may cooperatively engage the threaded surface defining the fifth radial passage surface portion 48*e* of the radial passage surface 48 defining the radial passage 46. Then, the retaining washer 24 may be rotated relative the housing 18 until: (1) the distal surface 80 of the retaining washer 24 is disposed adjacent the fourth radial passage surface portion 48*d*/ second shoulder surface of the radial passage surface 48 defining the radial passage 46, and (2) the proximal surface 82 of the retaining washer 24 is aligned with the right side surface 36 of the housing 18. As the retaining washer 24 is rotated as described above, the distal surface 80 of the retaining washer 24 axially engages the proximal end 76 of the spring member 22, and, as the retaining washer 24 further threadingly engages the housing 18, the retaining washer 24 further compresses the spring member 22 between the proximal shoulder surface 66*p* of the collar portion 66 and the distal surface 80 of the retaining washer 24.

Once the retaining washer 24 is fully threadingly coupled to the housing 18 as described above, the locking pin 20 and the spring member 22 may be said to be secured to the housing 18 whereby the spring member 22 is contained within the radial passage 46 and a portion $L_{70}$ (see, e.g., FIGS. 3-4) of the length of the proximal portion 70 of the locking pin 20 extends through both of the spring member 22 and the retaining washer 24 such that the portion $L_{70}$ of the length of the proximal portion 70 extends beyond the right side surface 36 of the housing 18. The ring 26 may then be disposed within each of the radial passage 72 formed by the locking pin 20 and the radial passage 98 formed by the actuator 28 for joining the locking pin 20 to the actuator 28.

Referring to FIGS. 1A and 5-8, a second subassembly of the base portion 12 is shown generally at 12*b*. The second subassembly 12*b* may include but is not limited to including: a housing receiver 100 and a plurality of fasteners 102.

Referring to FIG. 1A, the housing receiver 100 may generally define a substantially planar body portion 104 having a front surface 106 and a rear surface 108. The substantially planar body portion 104 may also define a plurality of passages 110. The plurality of passages 110 may serve several purposes such as, for example: reducing the weight of the housing receiver 100 and the amount of material and cost associated with the manufacturing of the housing receiver 100. Furthermore, the plurality of passages 110 may also permit the housing receiver 100 to be attached to an article of clothing, such as, for example, a vest (e.g., a modular lightweight load-carrying equipment (MOLLE) vest), a harness, one or more strap members or the like as seen in FIGS. 19A-22C.

A substantially central portion of the housing receiver 100 may be shaped (e.g., stamped, embossed or the like) in order to form a housing receiving pocket 112. The housing receiving pocket 112 may be sized for receiving the housing 18 as defined by the front surface 30, the left side surface 34, the right side surface 36, the upper surface 38 and the lower surface 40.

A portion of the substantially planar body portion 104 and the housing receiving pocket 112 may also cooperatively form a left side passage 114*a* and a right side passage 114*b*. The left side passage 114*a* or the right side passage 114*b* may permit the portion $L_{70}$ of the length of the proximal portion 70 of the locking pin 20 and the actuator 28 to be accessible by an operator.

The housing receiving pocket 112 may also define a plurality of fastener-receiving passages 116. The plurality of fasteners 102 may be disposed within the plurality of fastener-receiving passages 116. A central passage 117 may also be formed by the housing receiving pocket 112. The central passage 117 may define a diameter that is approximately equal to the diameter $D_{42}$ of the passage 42 extending through the housing 18.

In order to attach the first subassembly 12*a* to the second subassembly 12*b*, firstly, as seen in FIG. 1A, the housing 18 is arranged opposite the rear surface 108 of the substantially planar body portion 104 of the housing receiver 100. Then, the portion $L_{70}$ of the length of the proximal portion 70 of the locking pin 20 and the actuator 28 is extended through one of the left side passage 114*a* and the right side passage 114*b*. Then, as seen in FIG. 1B, the housing 18 is disposed within the housing receiving pocket 112 of the housing receiver 100.

Upon disposing the housing 18 within the housing receiving pocket 112 of the housing receiver 100, the plurality of fastener-receiving passages 50 of the housing 18 are aligned with the plurality of fastener-receiving passages 116 formed by the housing receiving pocket 112. Then, the plurality of fasteners 102 may be disposed within the plurality of fastener-receiving passages 116 and subsequently extended into the plurality of fastener-receiving passages 50 of the housing 18 for attaching the first subassembly 12*a* to the second subassembly 12*b* for forming the base portion 12.

Referring to FIG. 1A, a subassembly of the selectively rotatable portion 14 is shown generally at 14*a*. The subassembly 14*a* may include but is not limited to including: an implement carrier portion 118, an indexing member 120 and a plurality of fasteners 122.

The implement carrier portion 118 may generally define a substantially planar body portion 124 having a front surface 126 and a rear surface 128. The substantially planar body portion 124 may also define a plurality of passages 130. The plurality of passages 130 may serve several purposes such as, for example: reducing the weight of the implement carrier portion 118 and the amount of material and cost associated with the manufacturing of the implement carrier portion 118. Furthermore, as will be described in the following disclosure, the plurality of passages 130 may also permit the implement carrier portion 118 to be attached to the quick-deployment implement retainer portion 16. A substantially central portion of the implement carrier portion 118 may define a plurality of fastener-receiving passages 132.

The indexing member 120 includes a substantially cylindrical body 134 having a front surface 136, a rear surface 138 and a substantially circumferential side surface 140. The front surface 136 defines a plurality of fastener-receiving passages 142. The substantially circumferential side surface 140 defines a recessed circumferential channel 144. The substantially circumferential side surface 140 also defines alignment key channels 146 that are in fluid communication with the recessed circumferential channel 144. The alignment key channels 146 extend from the rear surface 138 of the indexing member 120.

Figure 13:
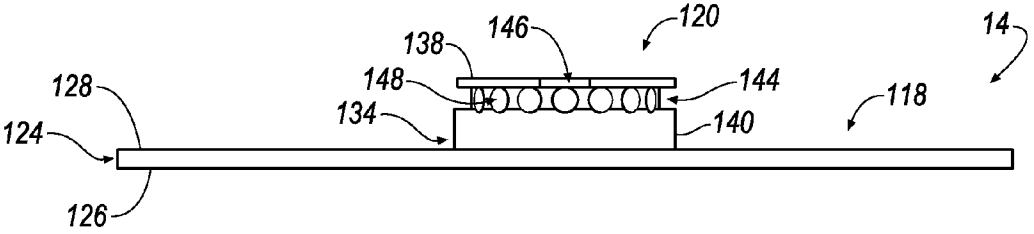
FIG. 13 is a top view of the selectively rotatable portion of the hands-free support device according to arrow 13 of FIG. 10.
Figure 15:
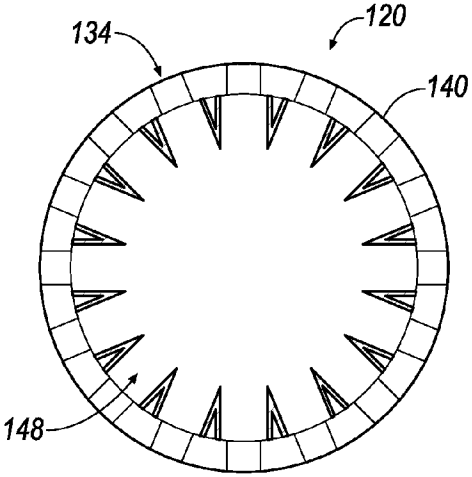
FIG. 15 is a cross-sectional view of an indexing member of the selectively rotatable portion of the hands-free support device according to line 15-15 of FIG. 1A.
Figure 14:
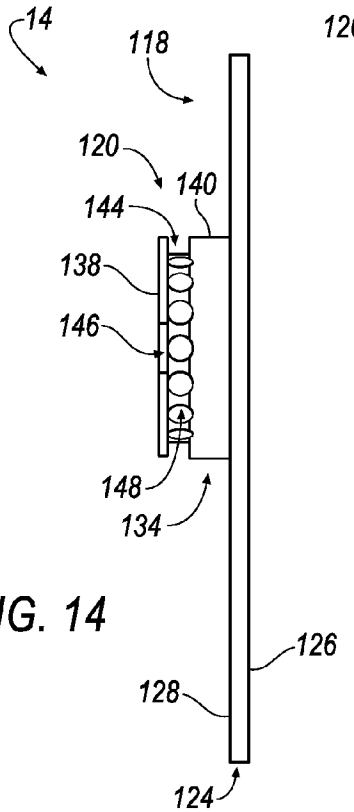
FIG. 14 is a side view of the selectively rotatable portion of the hands-free support device according to arrow 14 of FIG. 10.

Referring to FIGS. 13-15, a plurality of locking pin receiving passages 148 are circumferentially arranged within the recessed circumferential channel 144 of the indexing member 120. In some instances, the plurality of locking pin receiving passages 148 may include a total of sixteen locking pin receiving passages 148.

In order to attach the indexing member 120 to the implement carrier portion 118, firstly, as seen in FIG. 1A, the indexing member 120 is arranged opposite the rear surface 128 of the substantially planar body portion 124 of the implement carrier portion 118. The plurality of fastener-receiving passages 142 of the indexing member 120 are aligned with the plurality of fastener-receiving passages 132 formed by the implement carrier portion 118. Then, the plurality of fasteners 122 may be disposed within the plurality of fastener-receiving passages 132 of the implement carrier portion 118 and subsequently extended into the plurality of fastener-receiving passages 142 of the indexing member 120 for attaching the implement carrier portion 118 to the indexing member 120 for forming the selectively rotatable portion 14 as seen in FIGS. 9-15.

Figure 16A:
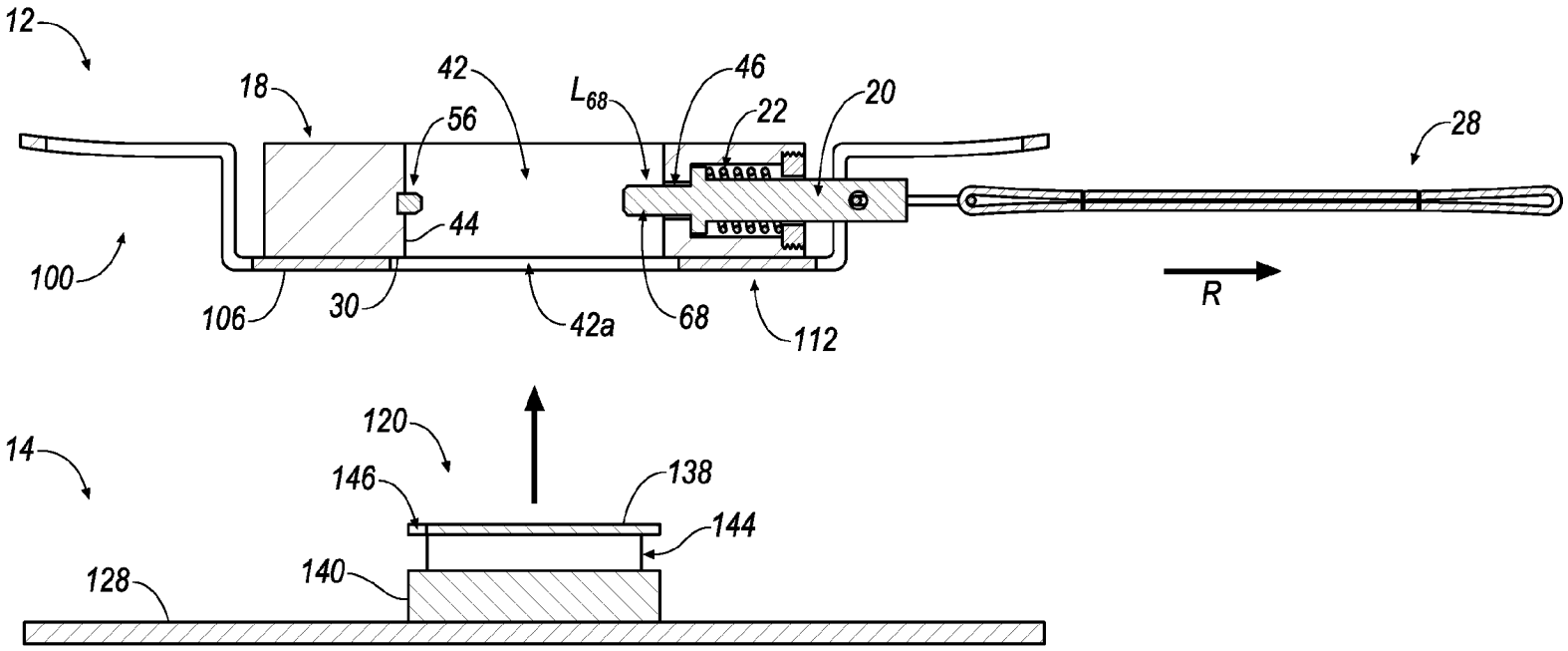
FIG. 16A is a cross-sectional view of the base portion and the selectively rotatable portion of the hands-free support device according to line 16A-16A of FIG. 1B.

Referring to FIGS. 1B-1C and 16A-16C, the selectively rotatable portion 14 is attached to the base portion 12. Firstly, as seen in FIGS. 1B and 16A, the indexing member 120 of the selectively rotatable portion 14 is axially aligned with the central passage 117 extending through the housing receiving pocket 112 and the axial passage 42 extending through the housing 18 of the base portion 12 such that the rear surface 138 of the indexing member 120 is arranged directly opposite the first opening 42*a* formed by the front surface 30 of the housing 18 that permits access to the axial passage 42. Furthermore, as seen in FIG. 16A, prior to attaching the selectively rotatable portion 14 to the base portion 12, the alignment key channels 146 defined by the substantially circumferential side surface 140 of the indexing member 120 are axially aligned with the alignment keys 56 that extend radially inwardly away from the axial passage surface 44 that defines the axial passage 42.

Figure 16B:
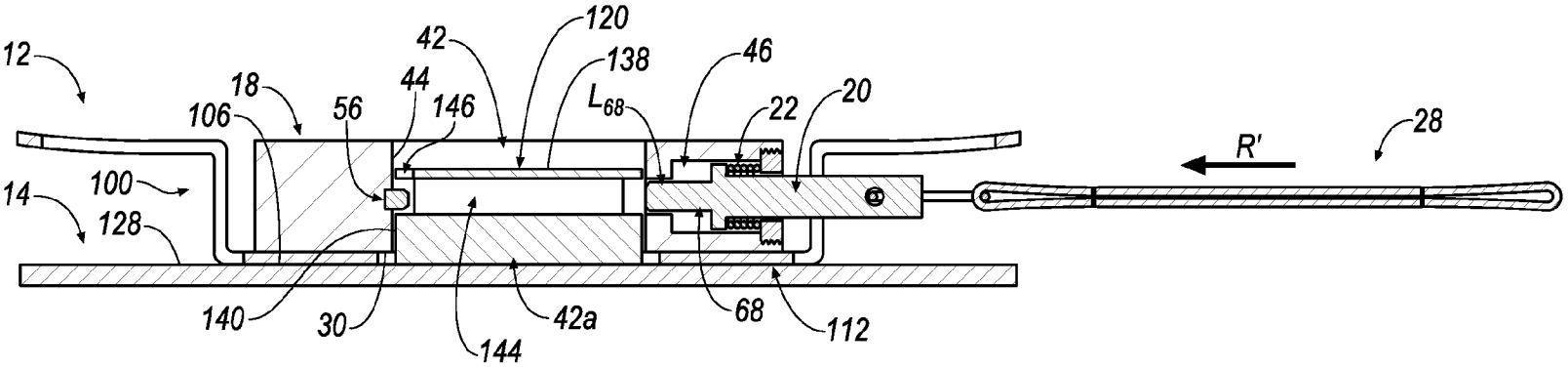
FIG. 16B is a cross-sectional view of the base portion and the selectively rotatable portion of the hands-free support device according to line 16B-16B of FIG. 1C.

Referring to FIG. 16A, just prior to attaching the selectively rotatable portion 14 to the base portion 12, the operator may apply a radially-outward force in the direction of arrow, R, to the actuator 28 in order to overcome the bias applied to the locking pin 20 by the spring member 22, which radially urges the portion of the length $L_{68}$ of the distal portion 68 of the locking pin 20 into the axial passage 42 that extends through the housing 18. Referring to FIG. 16B, as result of the application of the radially-outward force, R, the portion of the length $L_{68}$ of the distal portion 68 of the locking pin 20 is radially withdrawn from the axial passage 42 and into the radial passage 46 of the housing 18.

Referring to FIG. 16B, with the portion of the length $L_{68}$ of the distal portion 68 of the locking pin 20 being radially withdrawn from the axial passage 42 and into the radial passage 46 of the housing 18, the rear surface 138 of the indexing member 120 is: (1) firstly inserted through the central passage 117 formed by the housing receiving pocket 112, and (2) secondly inserted into the axial passage 42 by way of the first opening 42*a* formed by the front surface 30 of the housing 18. As the indexing member 120 is further inserted into the passage 42, the alignment keys 56 that extend radially inwardly away from the axial passage surface 44 that defines the axial passage 42 are axially passed through the alignment key channels 146 defined by the substantially circumferential side surface 140 of the indexing member 120. Upon fully inserting the indexing member 120 within the passage 42 (such that, e.g., the rear surface 128 of the substantially planar body portion 124 of the implement carrier portion 118 is disposed adjacent the front surface 106 housing receiver 100 defined by the housing receiving pocket 112), the alignment keys 56 may be axially passed beyond the alignment key channels 146 for arrangement within the recessed circumferential channel 144 of the indexing member 120.

Referring to FIG. 16B, once the indexing member 120 is fully inserted within the passage 42 formed by the housing 18, the radial passage 46 of the housing 18 may be radially aligned with the recessed circumferential channel 144 of the indexing member 120. The operator may then cease application of the radially-outward force, R, to the actuator 28 in order to permit the spring member 22 to expand and apply a radially-inward force in the direction of arrow, R', to the locking pin 20.

Figure 16C:
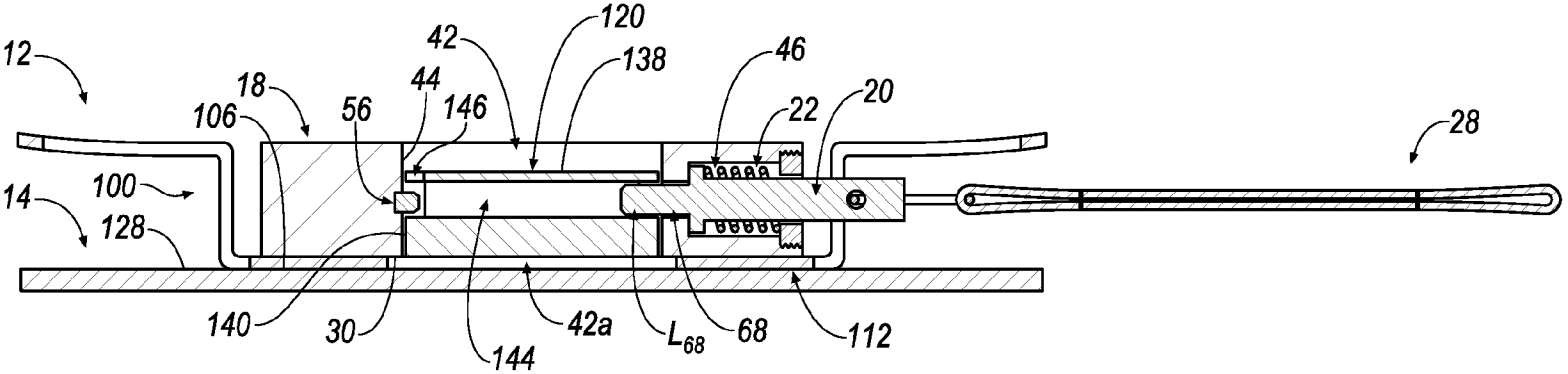
FIG. 16C is a cross-sectional view of the base portion and the selectively rotatable portion of the hands-free support device according to line 16CB-16C of FIG. 1C.

Referring to FIG. 16C, as result of the application of the radially-inward force, R', to the locking pin 20, the portion of the length $L_{68}$ of the distal portion 68 of the locking pin 20 plunges radially inwardly from a first position within the radial passage 46 to a second position within the axial passage 42 that now contains the indexing member 120. Because the radial passage 46 of the housing 18 may be radially aligned with the recessed circumferential channel 144 of the indexing member 120, the portion of the length $L_{68}$ of the distal portion 68 of the locking pin 20 plunges radially inwardly into the recessed circumferential channel 144, thereby joining the selectively rotatable portion 14 to the base portion 12.

Figure 17A:
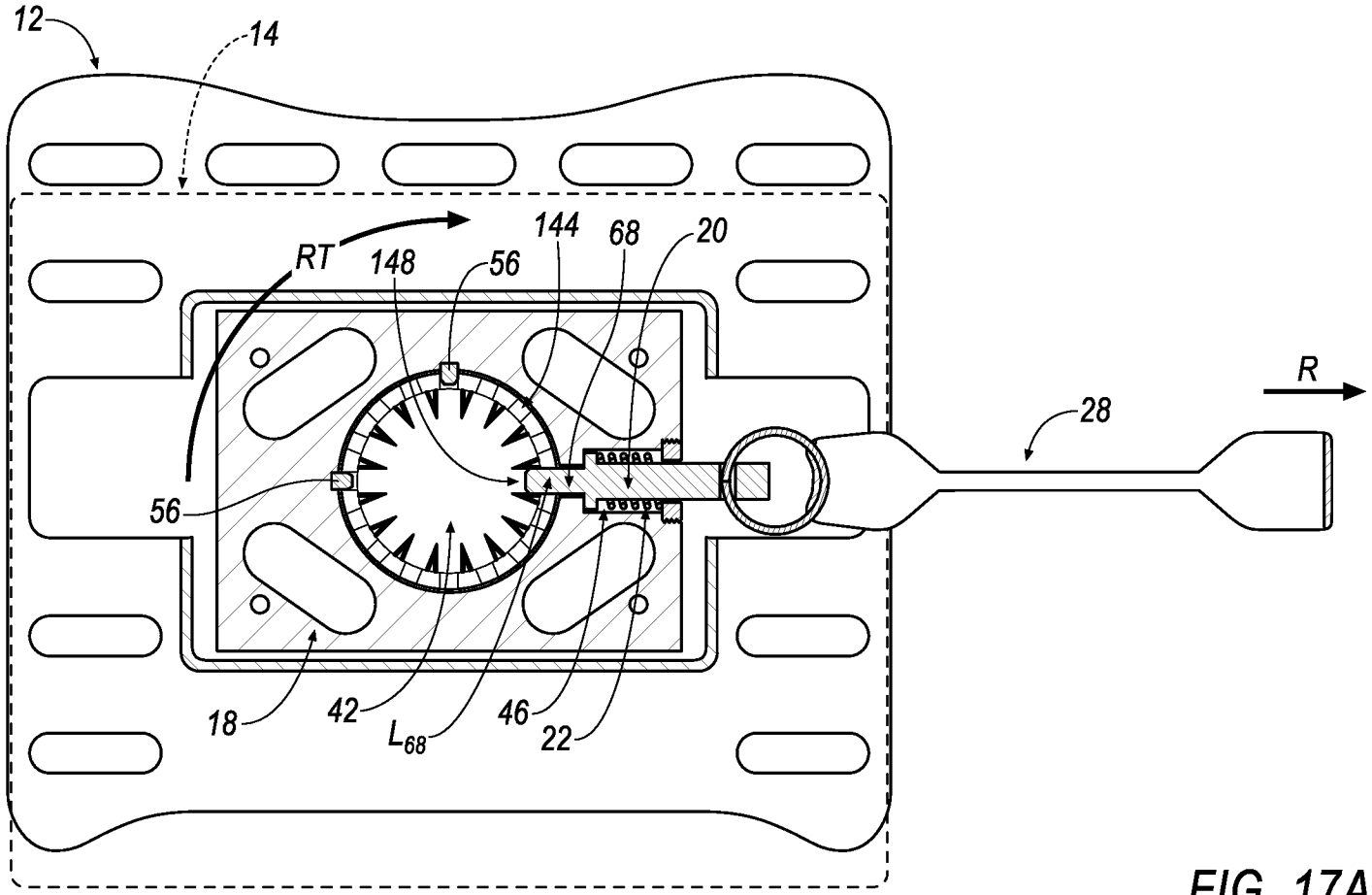
FIG. 17A is a front, partial cross-sectional view of the base portion and the selectively rotatable portion of the hands-free support device of FIGS. 1A-1F, illustrating the selectively rotatable portion in a first, locked orientation relative to the base portion.

Referring to FIG. 17A, the arrangement of the portion of the length $L_{68}$ of the distal portion 68 of the locking pin 20 within the recessed circumferential channel 144 further permits the portion of the length $L_{68}$ of the distal portion 68 of the locking pin 20 to be arranged within one locking pin receiving passages 148 of the plurality of locking pin receiving passages 148 that are circumferentially arranged within the recessed circumferential channel 144. Arrangement of the portion of the length $L_{68}$ of the distal portion 68 of the locking pin 20 within one locking pin receiving passages 148 of the plurality of locking pin receiving passages 148 permits the selectively rotatable portion 14 to be selectively rotatably locked to the base portion 12 in one of a plurality (e.g., sixteen) of orientations determined by the number (e.g., sixteen) of locking pin receiving passages 148 included in the plurality of locking pin receiving passages 148.

Figure 17B:
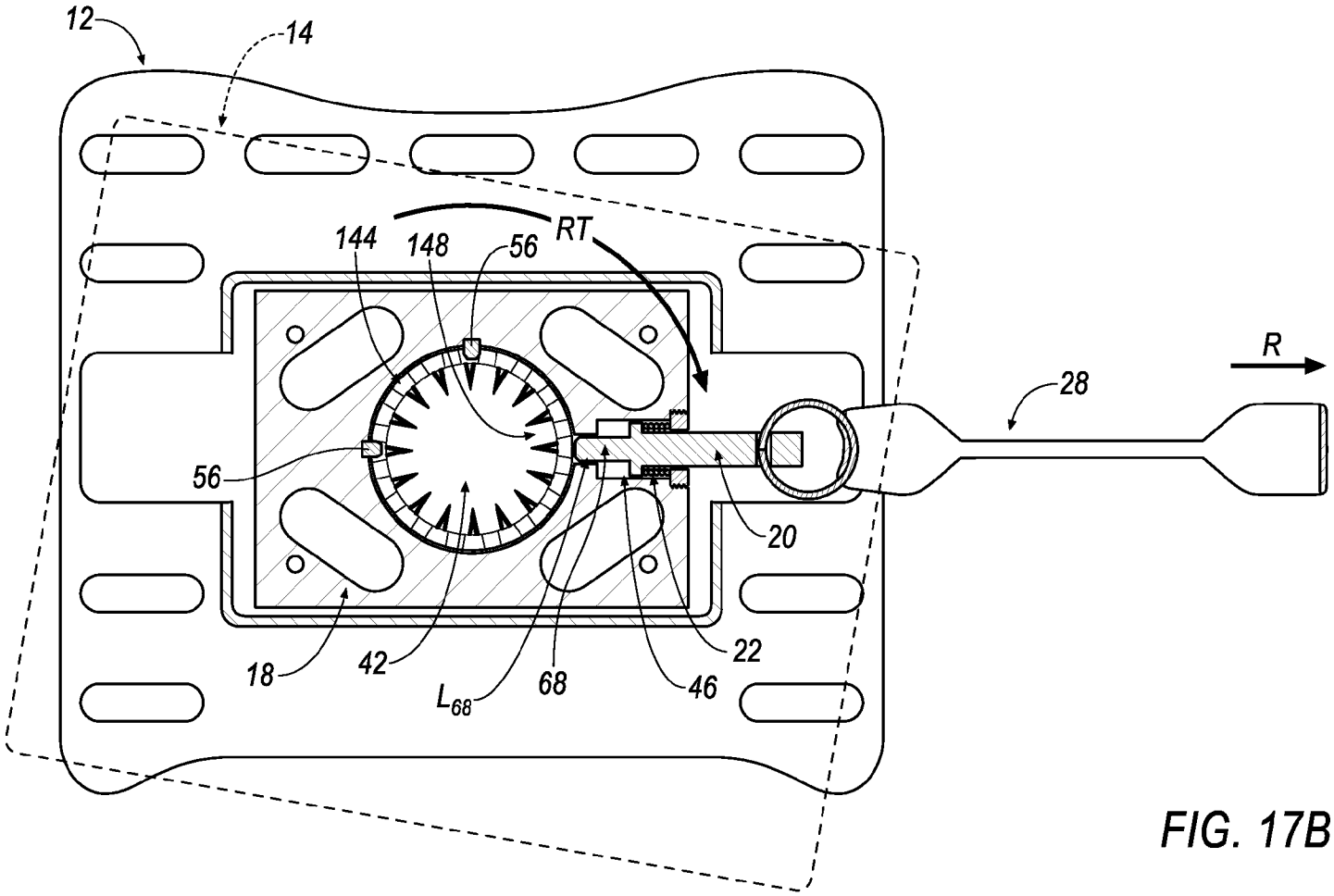
FIG. 17B is a front, partial cross-sectional view of the base portion and the selectively rotatable portion of the hands-free support device of FIGS. 1A-1F, illustrating the selectively rotatable portion in a rotated and unlocked orientation relative to the base portion in reference to FIG. 17A.

The orientation of the selectively rotatable portion 14 relative the base portion 12 may be manipulated when an operator applies a radially-outward force in the direction of arrow, R, to the actuator 28 in order to overcome the bias applied to the locking pin 20 by the spring member 22, which radially urges the portion of the length $L_{68}$ of the distal portion 68 of the locking pin 20 out of the axial passage 42 that extends through the housing 18. As seen in FIG. 17B, as result of the application of the radially-outward force, R, the portion of the length $L_{68}$ of the distal portion 68 of the locking pin 20 is withdrawn from the axial passage 42 and radially into the radial passage 46 of the housing 18, which results in the portion of the length $L_{68}$ of the distal portion 68 of the locking pin 20 no longer being arranged within the one locking pin receiving passages 148 of the plurality of locking pin receiving passages 148, and, as a result, the selectively rotatable portion 14 is permitted to be selectively rotatably unlocked with respect to the base portion 12.

Once the selectively rotatable portion 14 is selectively rotatably unlocked with respect to the base portion 12, the operator may freely rotate, RT, the selectively rotatable portion 14 relative the base portion 12. Rotation of the selectively rotatable portion 14 relative the base portion 12 is permitted as a result of the arrangement of the alignment keys 56 within the recessed circumferential channel 144.

Figure 17C:
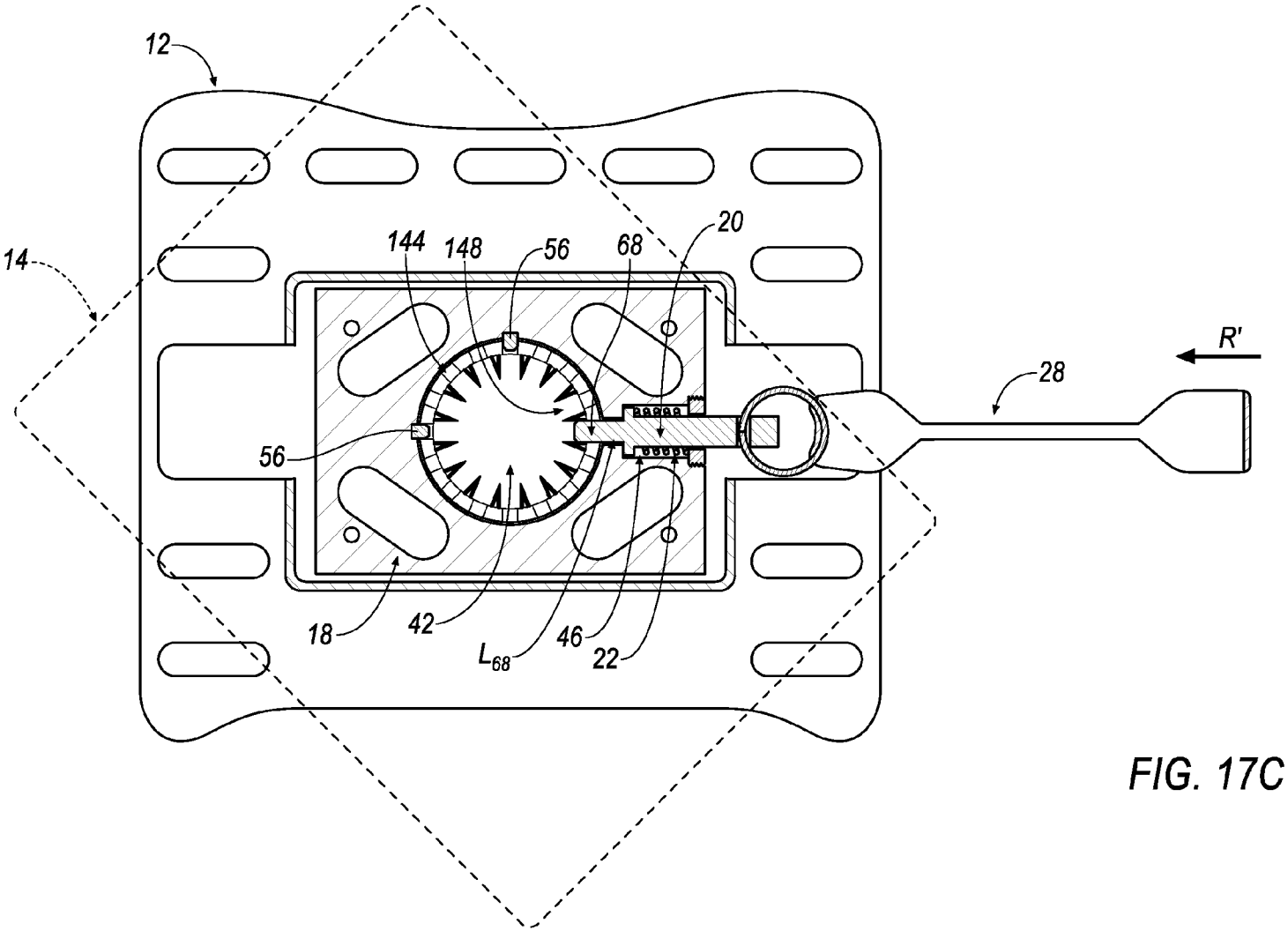
FIG. 17C is a front, partial cross-sectional view of the base portion and the selectively rotatable portion of the hands-free support device of FIGS. 1A-1F, illustrating the selectively rotatable portion in a further rotated and second, locked orientation relative to the base portion in reference to FIG. 17B.

Referring to FIG. 17C, once the operator has rotated the selectively rotatable portion 14 to a desired orientation relative to the base potion 12, the operator may cease the application of the radially-outward force, R, to the actuator 28 in order to permit the spring member 22 to expand and apply a radially-inward force in the direction of arrow, R', to the locking pin 20. As result of the application of the radially-inward force, R', to the locking pin 20, the portion of the length $L_{68}$ of the distal portion 68 of the locking pin 20 plunges radially inwardly from a first position within the radial passage 46 to a second position within the axial passage 42 such that the portion of the length $L_{68}$ of the distal portion 68 of the locking pin 20 plunges radially inwardly into the recessed circumferential channel 144 and subsequently into another locking pin receiving passage 148 of the plurality of locking pin receiving passages 148 thereby selectively rotatably locking the selectively rotatable portion 14 to the base portion 12.

Figure 1E:
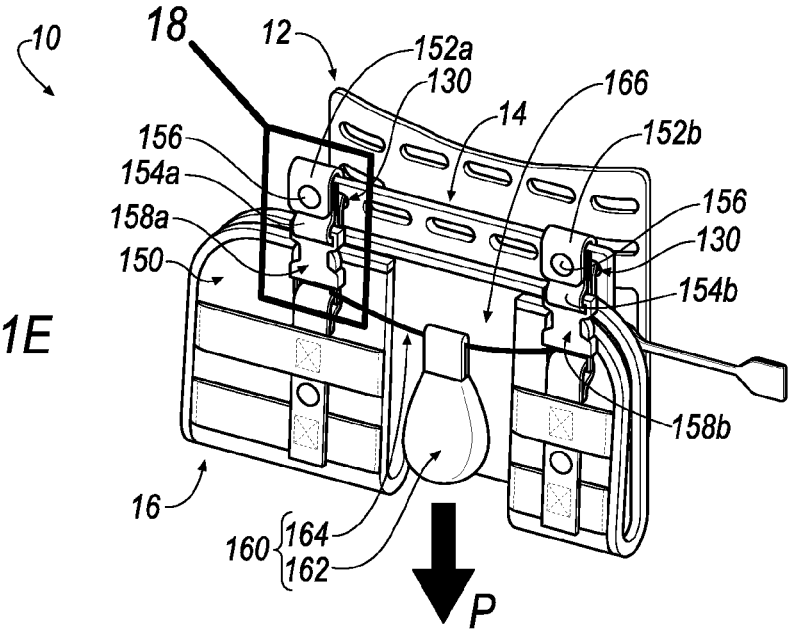
FIG. 1E is a perspective view of the hands-free support device of FIG. 1A, illustrating the hands-free support device in a closed orientation.

Referring to FIGS. 1C-1E, the quick-deployment implement retainer portion 16 may be attached to the selectively rotatable portion 14. As seen in FIGS. 1A-1C, in some instances, the quick-deployment implement retainer portion 16 may include a substantially planar body of foldable material 150. A first distal strap portion 152*a* and a second distal strap portion 152*b* may be attached to the substantially planar body of foldable material 150. A first proximal strap portion 154*a* and a second proximal strap portion 154*b* may also be attached to an opposite end of the substantially planar body of foldable material 150 with respect to the attachment location of the first distal strap portion 152*a* and the second distal strap portion 152*b*.

Referring to FIG. 1D, the first distal strap portion 152*a* and the second distal strap portion 152*b* may be respectively inserted through passages 130 formed in the substantially planar body portion 124 of the implement carrier portion 118. Then, as seen in FIG. 1E, the first proximal strap portion 154*a* and the second proximal strap portion 154*b* may be respectively joined to the first distal strap portion 152*a* and the second distal strap portion 152*b* (by way of, e.g., a snap button 156 or snap-fit connection).

When the first proximal strap portion 154*a* and the second proximal strap portion 154*b* may be respectively joined to the first distal strap portion 152*a* and the second distal strap portion 152*b*, the quick-deployment implement retainer portion 16 may be said to be attached to the selectively rotatable portion 14. Furthermore, when the first proximal strap portion 154*a* and the second proximal strap portion 154*b* may be respectively joined to the first distal strap portion 152*a* and the second distal strap portion 152*b*, the substantially planar body of foldable material 150 may be folded upon itself thereby forming a pouch for selectively retaining an implement (such as, e.g., a firearm, F) therein.

Referring back to FIG. 1A, the first proximal strap portion 154*a* may be attached to the substantially planar body of foldable material 150 by way of a first buckle member 158*a*, and, the second proximal strap portion 154*b* may be attached to the substantially planar body of foldable material 150 by way of a second buckle member 158*b*. The first buckle member 158*a* and the second buckle member 158*b* may be attached to a quick-release actuator 160. The quick-release actuator 160 may include a pull tab 162 and a pull string 164.

Referring to FIGS. 1E and 18A-18D, when an operator desires to quickly-deploy an implement (such as, e.g., a firearm, F) retained by the quick-deployment implement retainer portion 16, the operator may apply a pulling force, P, to the pull tab 162. The pulling force, P, may be translated to the pull string 164, which, in turn, is translated to each of the first buckle member 158*a* and the second buckle member 158*b* for the purpose of withdrawing (see, e.g., FIG. 18B) a male portion $158a_1$, $158b_1$ of each of the first buckle member 158*a* and the second buckle member 158*b* from a female portion $158a_2$, $158b_2$ of each of the first buckle member 158*a* and the second buckle member 158*b*.

Figure 18B:
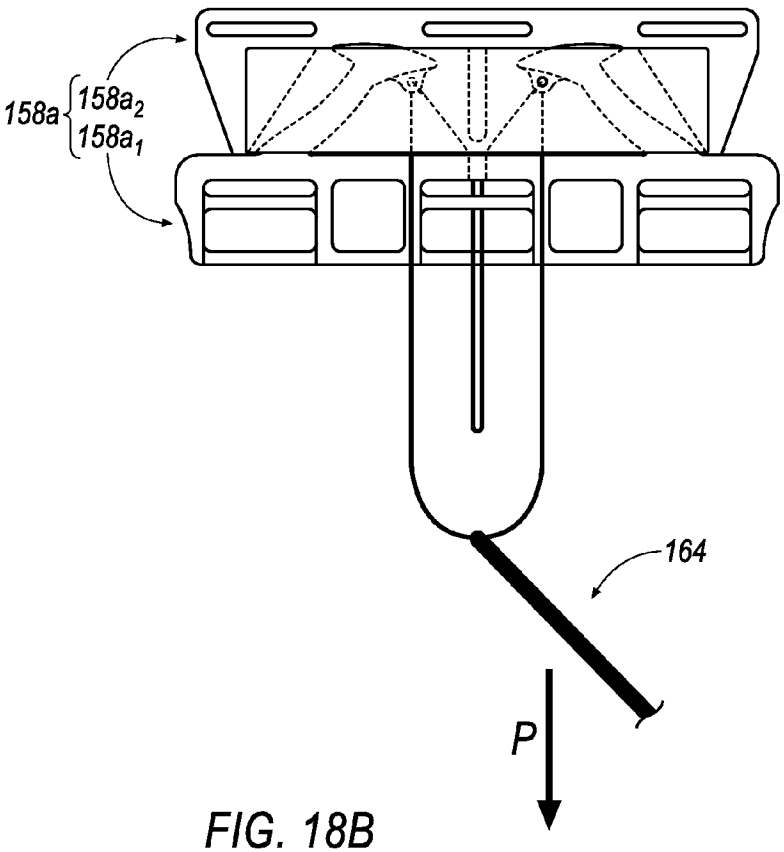
FIGS. 18A-18F are front views of a buckle member and a quick-release actuator.
Figure 18A:
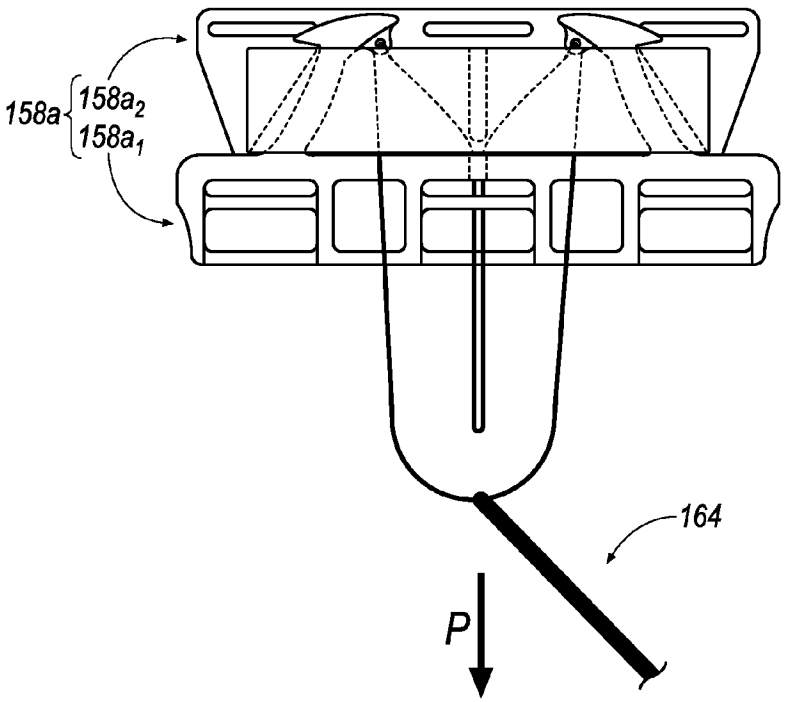
Figure 18D:
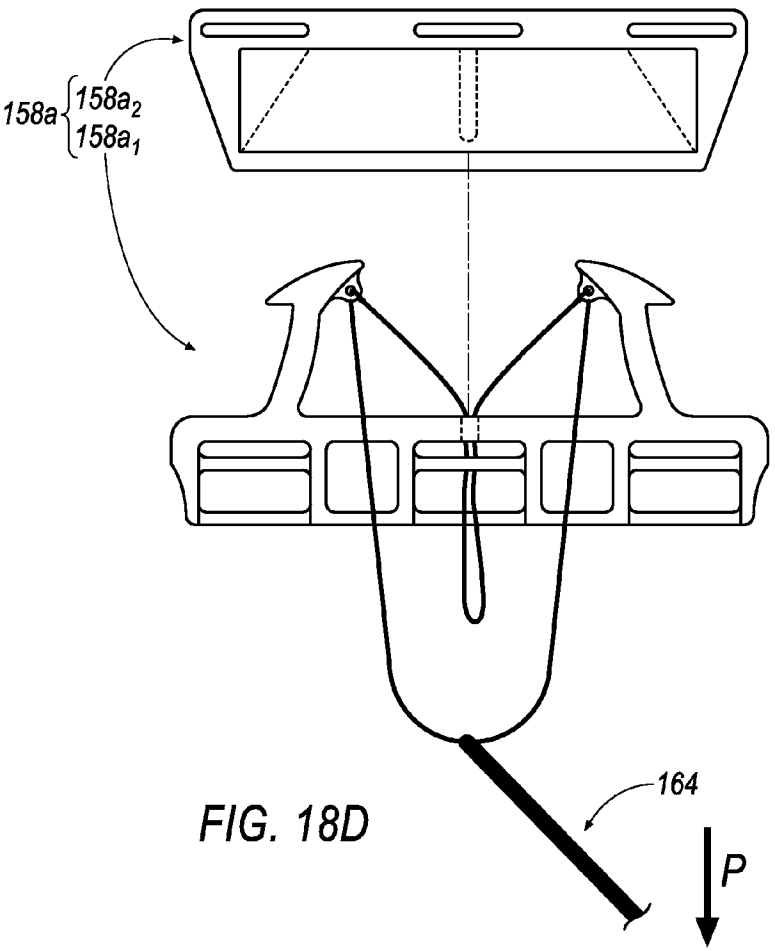
Figure 18C:
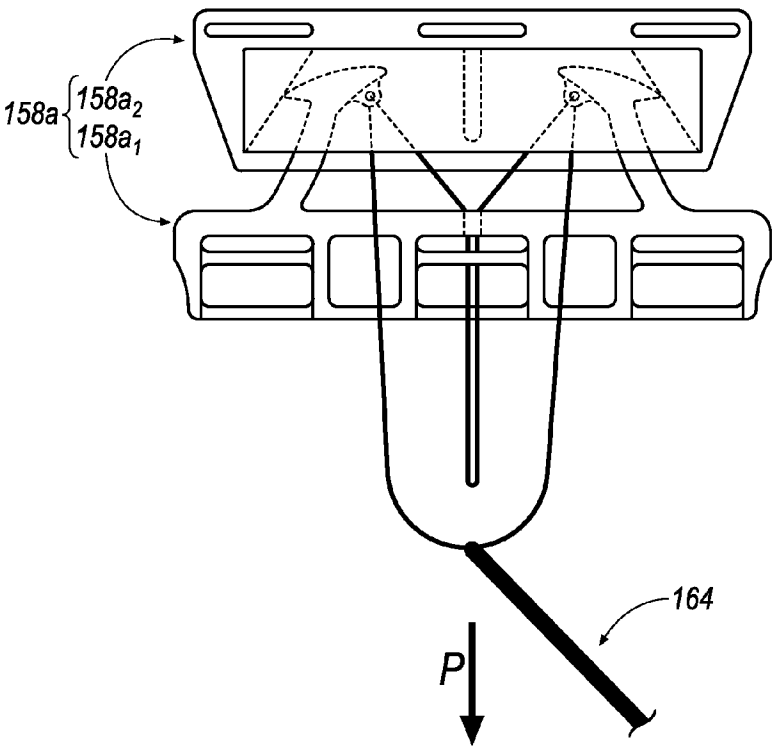
Figure 18F:
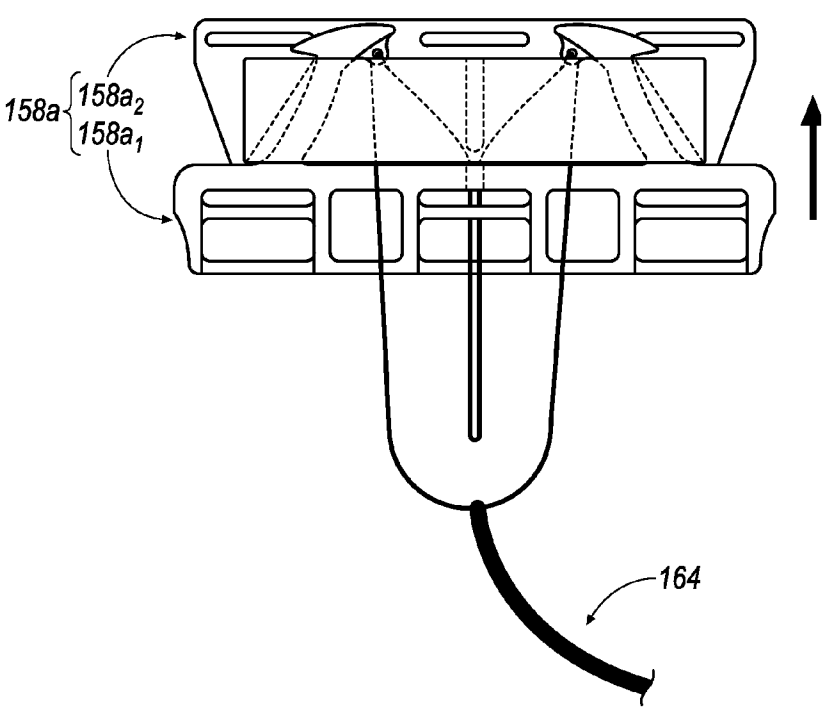
Figure 18E:
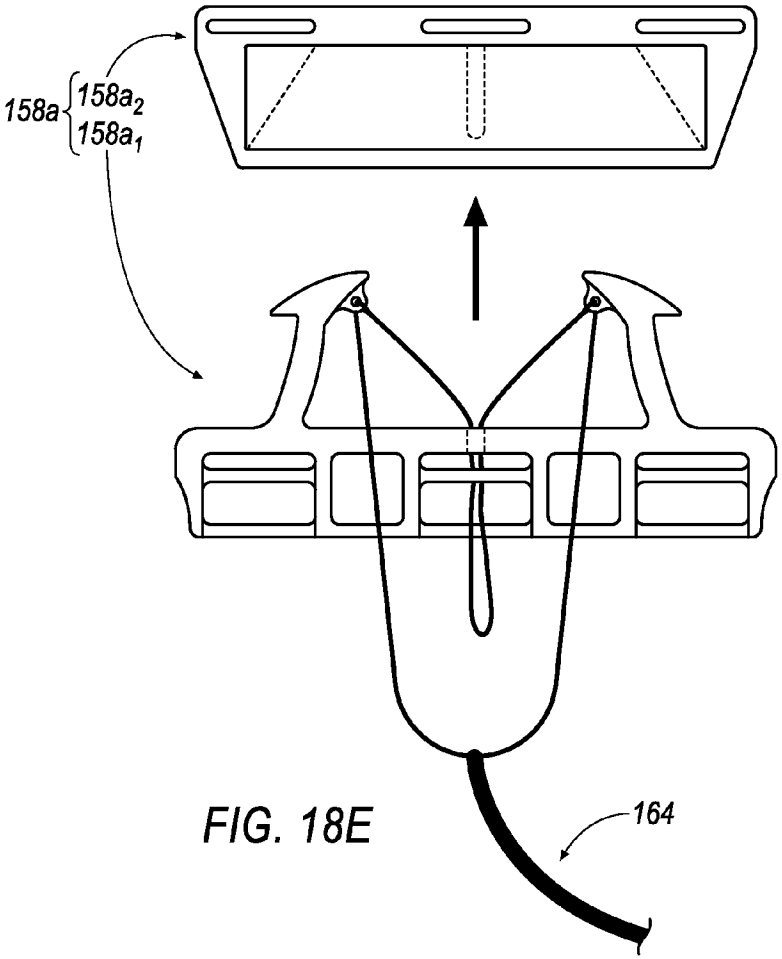

When an operator subsequently desires to return the implement to a stowed position within the quick-deployment implement retainer portion 16 the operator may re-attach the male portion $158a_1$, $158b_1$ of each of the first buckle member 158*a* and the second buckle member 158*b* to the female portion $158a_2$, $158b_2$ of each of the first buckle member 158*a* and the second buckle member 158*b*. As seen in FIGS. 18E-18F, the male portion $158a_1$, $158b_1$ of each of the first buckle member 158*a* and the second buckle member 158*b* may be subsequently inserted back into the female portion $158a_2$, $158b_2$ of each of the first buckle member 158*a* and the second buckle member 158*b* for returning the quick-deployment implement retainer portion 16 to a closed orientation (as seen in, e.g., FIG. 1E) from the deployed orientation (see, e.g., FIG. 1F).

Figure 19A:
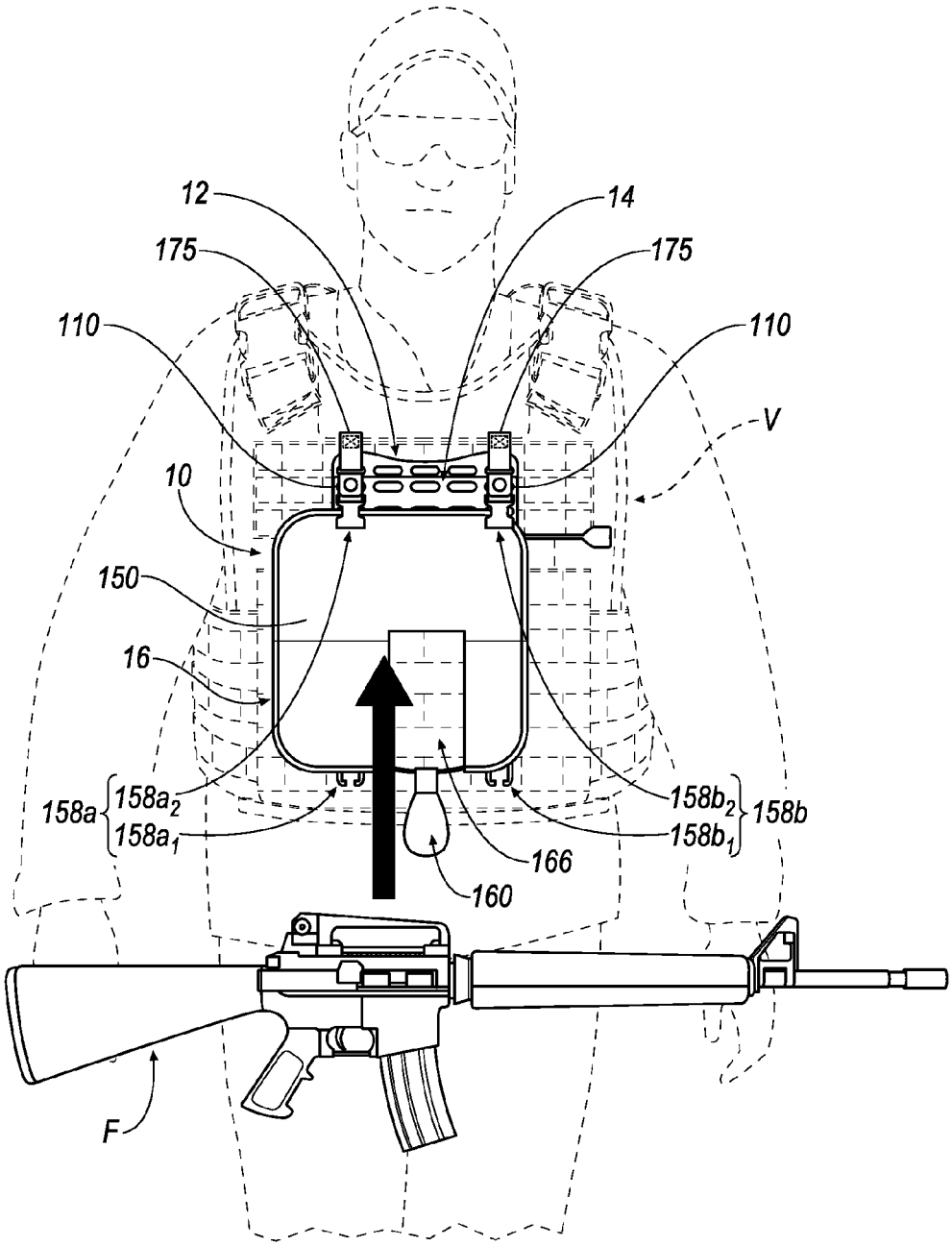
FIGS. 19A-19G are views of the hands-free support device of FIGS. 1A-1F attached to an article of clothing.
Figure 19B:
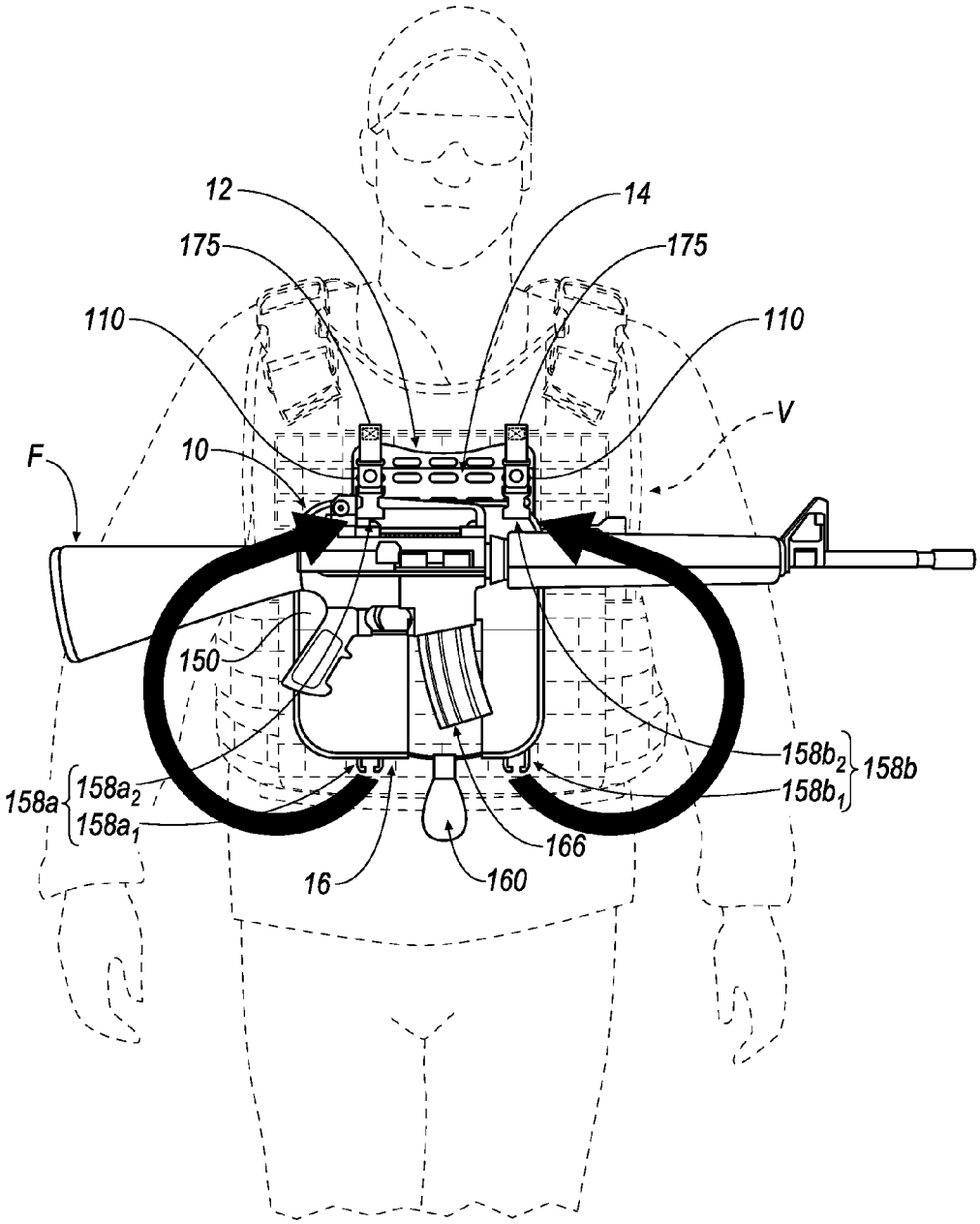
Figure 19C:
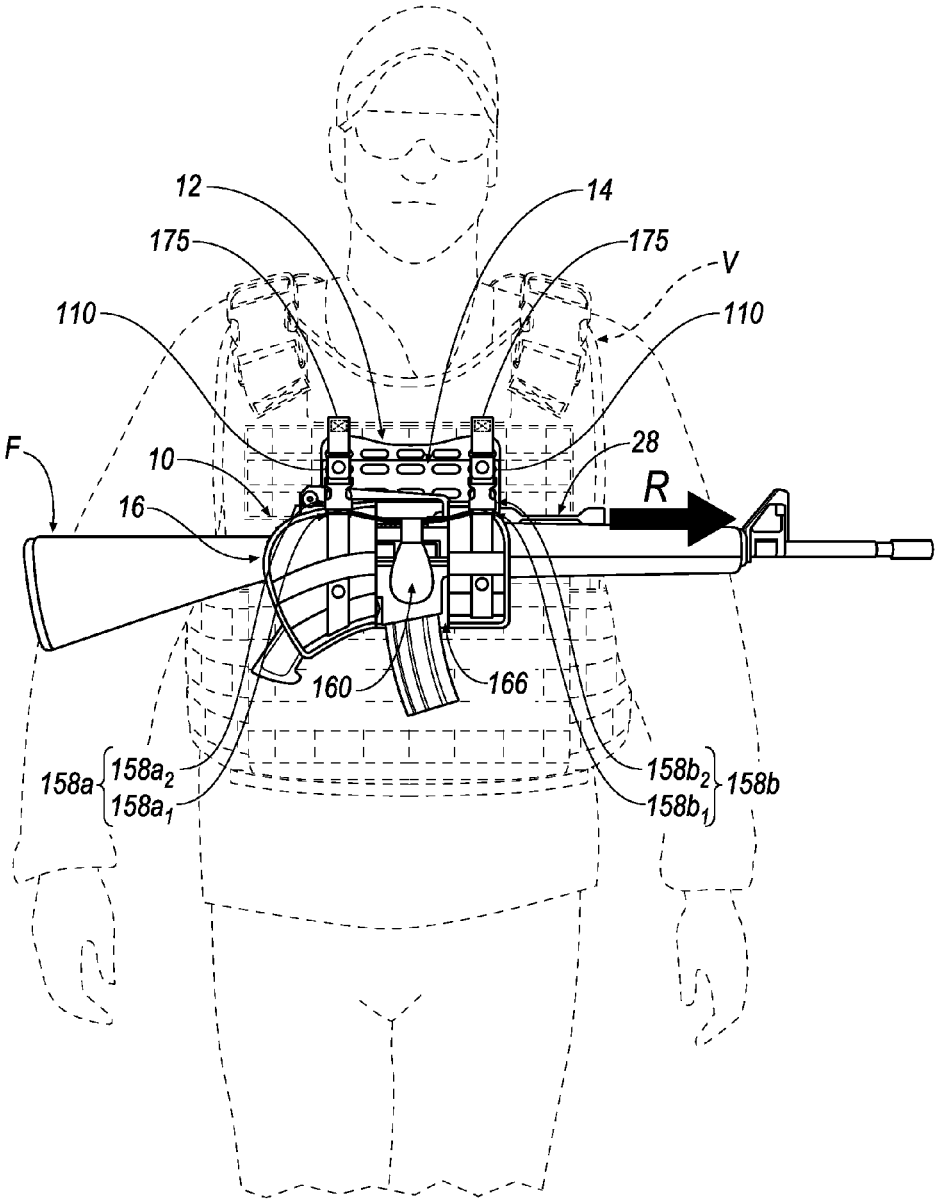
Figure 19D:
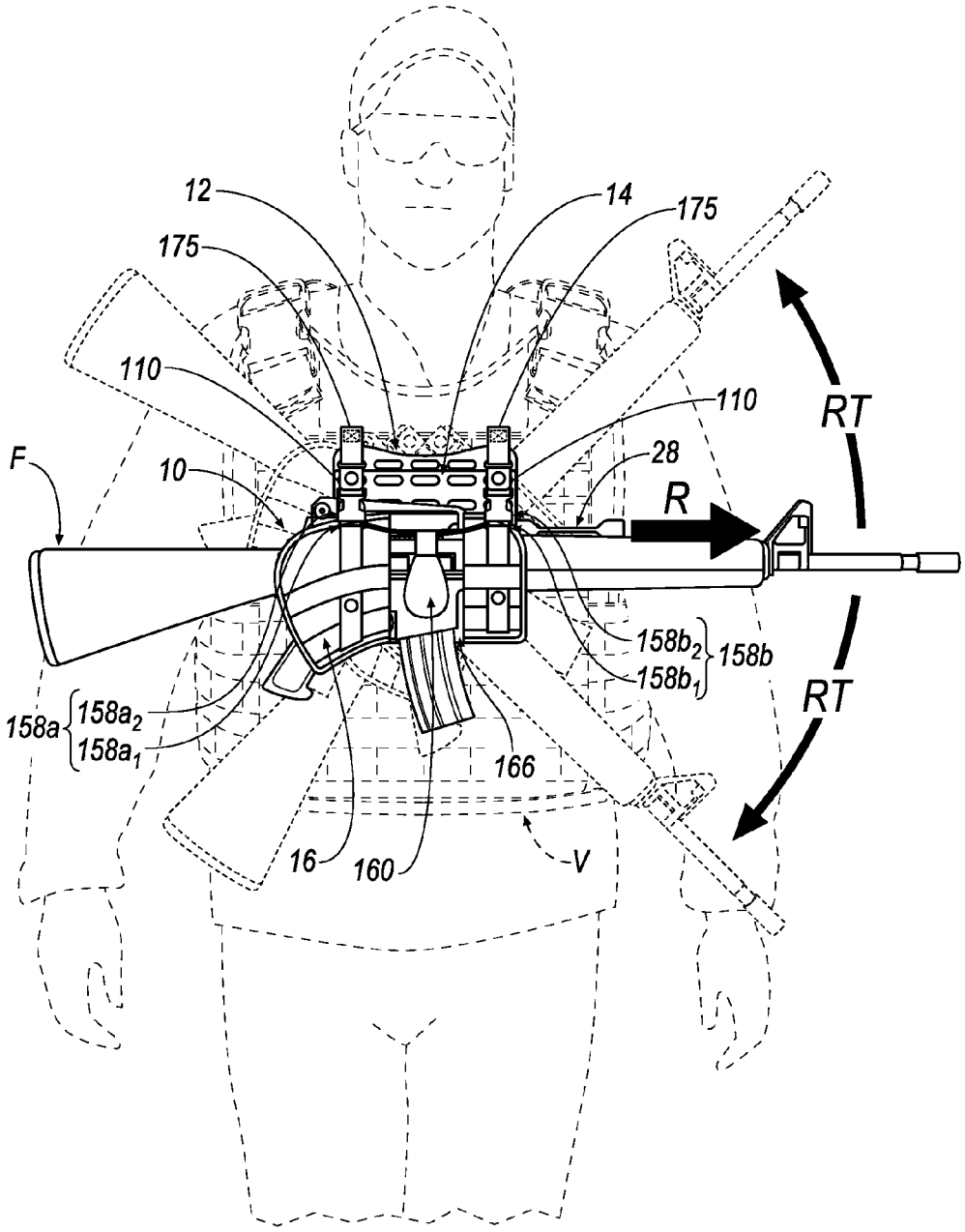

Referring to FIGS. 19A-19G, an exemplary method for utilizing the hands-free support device 10 is described. Firstly, as seen in FIG. 19A, the hands-free support device 10 may be attached to an article of clothing, V, such as, for example, a vest (e.g., a modular lightweight load-carrying equipment (MOLLE) vest) by way of, for example, one or more straps 175; the straps may include snap-buttons, VELCRO® or the like. The one or more straps may extend through, for example, one or more of the plurality of passages 110 formed in the substantially planar body portion 104 of the housing receiver 100 of the base portion 12. Therefore, the base portion 12 of the hands-free support device 10 may be said to be non-rotatable fixed to the vest, V. As seen in FIG. 19A, the vest, V, is disposed upon the operator's person.

Figure 1F:
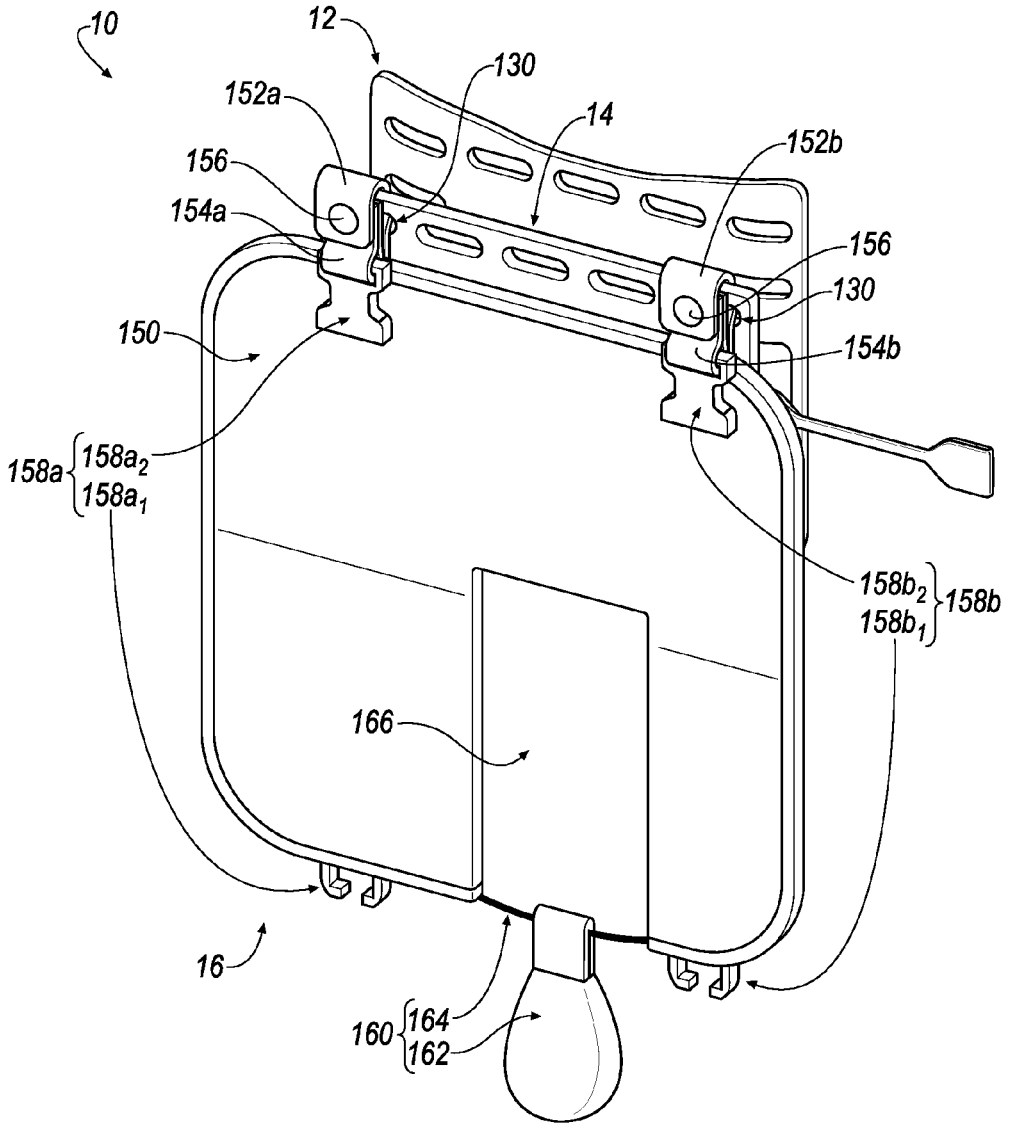
FIG. 1F is a perspective view of the hands-free support device of FIG. 1A, illustrating the hands-free support device in a deployed orientation.

As seen in FIG. 19A, the quick-deployment implement retainer portion 16 may be initially arranged a deployed orientation (as seen and described above at, e.g., FIG. 1F). As seen in FIG. 19B, the operator may arrange a firearm, F, about the substantially planar body of foldable material 150; subsequently, the operator may attach the first buckle member 158*a* and the second buckle member 158*b* (as seen as described above at, e.g., FIGS. 18E-18F) in order to arrange the quick-deployment implement retainer portion 16 in a closed orientation with the firearm, F, secured therein.

In some instances, the substantially planar body of foldable material 150 may form an opening 166. The opening 166 may permit a portion (e.g., a magazine) of the implement (e.g., a firearm) to extend through the substantially planar body of foldable material 150 once the implement is removably-secured to the quick-deployment implement retainer portion 16.

Referring to FIG. 19C, with the firearm, F, secured within the quick-deployment implement retainer portion 16, the operator may carry the firearm, F, on his person by way of the hands-free support device 10. As a result, the operator's hands are free to be utilized for one or more purposes other than carrying the firearm, F.

Figure 19E:
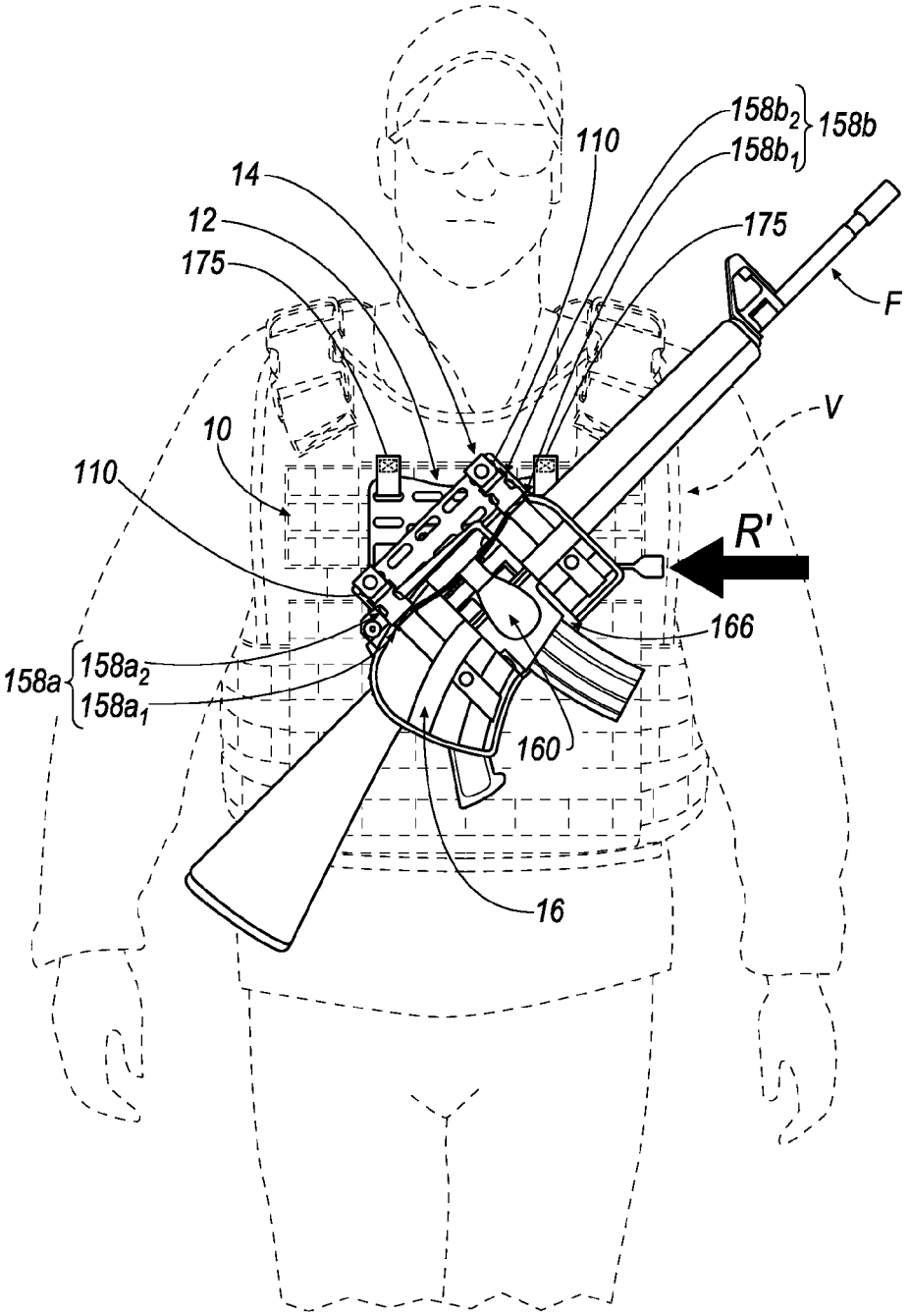
Figure 20:
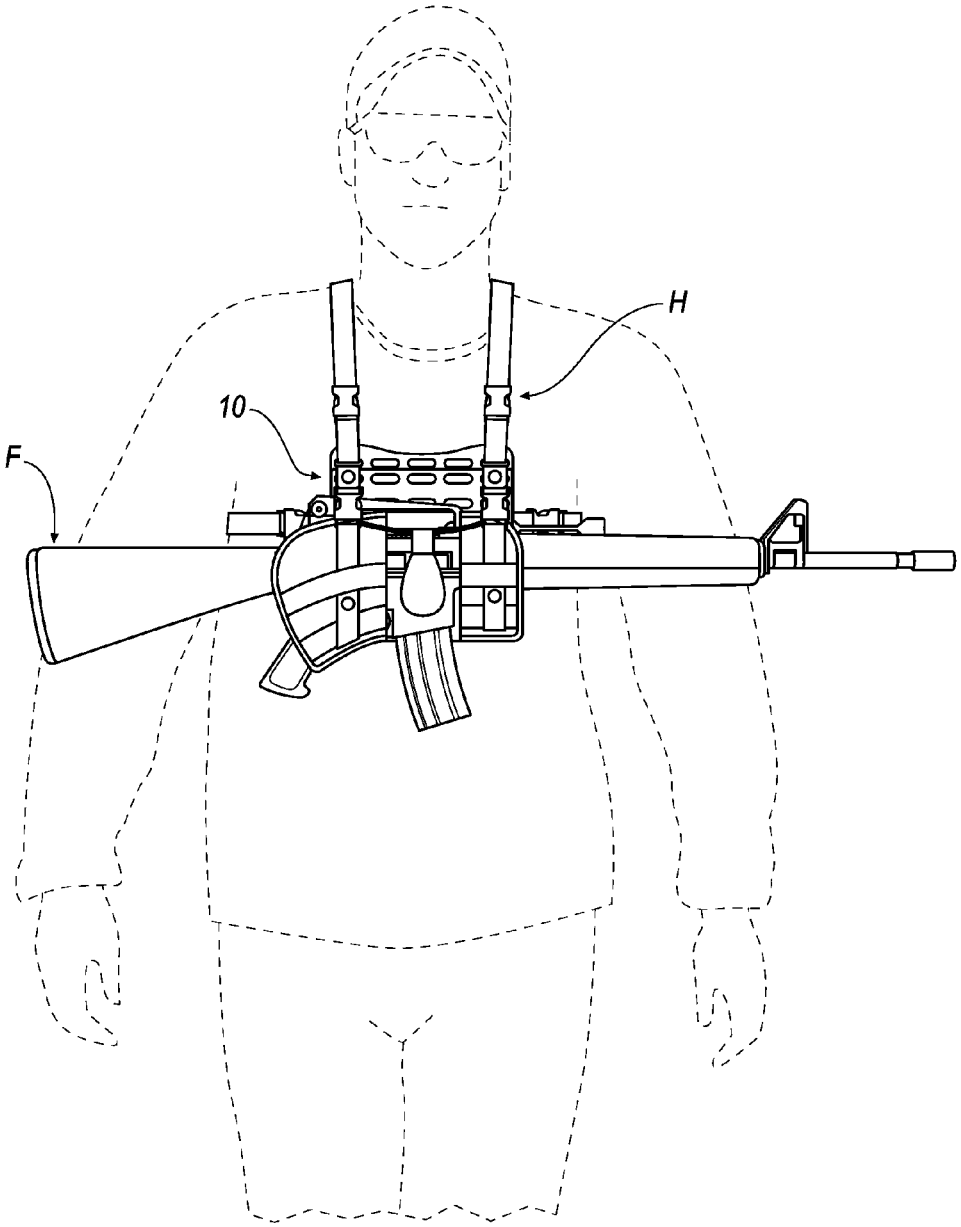
FIG. 20 is a view of the hands-free support device of FIGS. 1A-1F attached to a harness.

When the firearm, F, is secured within the quick-deployment implement retainer portion 16, the operator may apply a radially-outward force in the direction of arrow, R, to the actuator 28 (as seen as described above at, e.g., FIG. 16A) in order to permit the selectively rotatable portion 14 to be selectively rotatably unlocked with respect to the base portion 12 such that the operator may freely rotate, RT (see, e.g., FIGS. 17A-17B and 19D), the selectively rotatable portion 14 relative the base portion 12. Referring to FIG. 19E, once the operator has rotated the selectively rotatable portion 14 to a desired orientation relative to the base potion 12, the operator may cease the application of the radially-outward force, R, to the actuator 28 in order to permit the spring member 22 to expand and apply a radially-inward force in the direction of arrow, R', to the locking pin 20 (as seen as described above at, e.g., FIG. 16B).

Figure 19F:
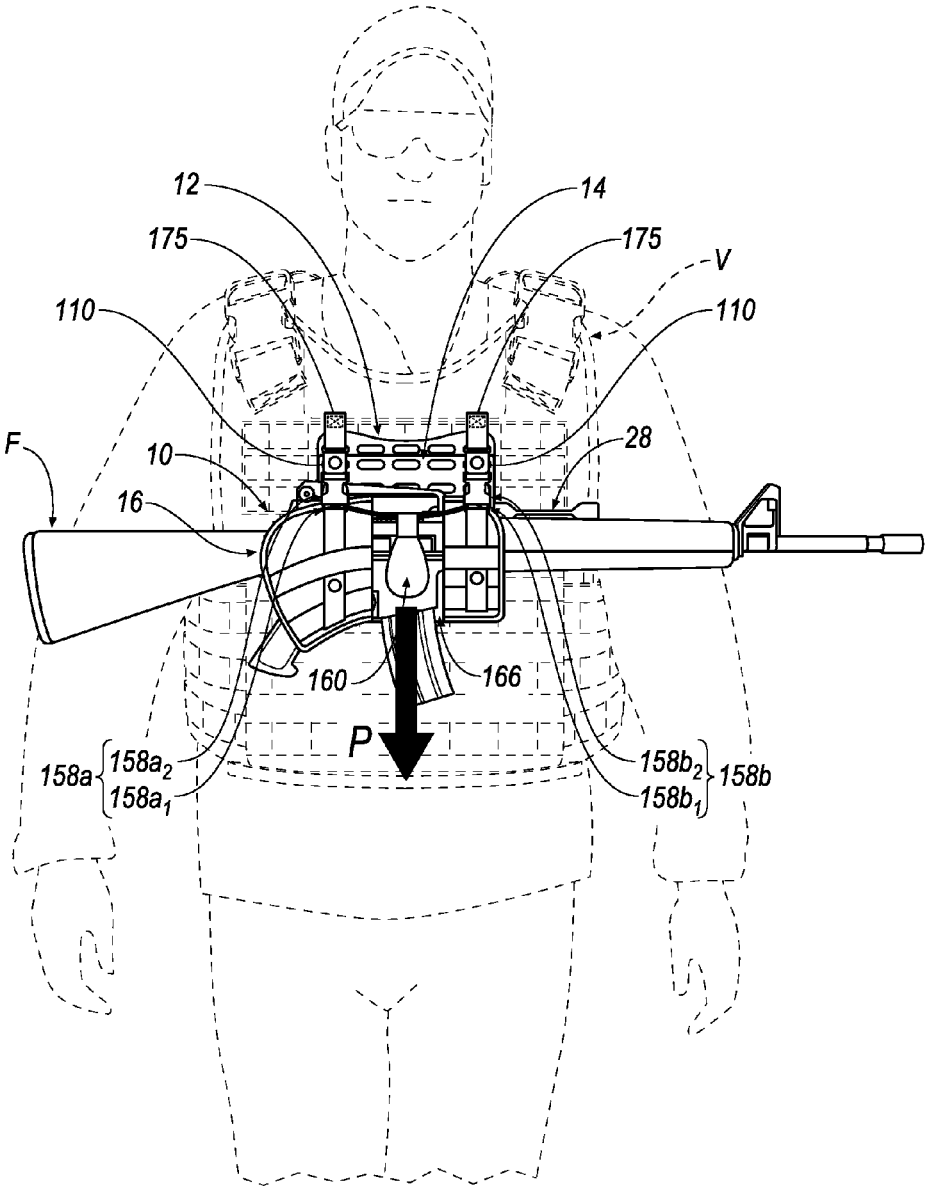
Figure 19G:
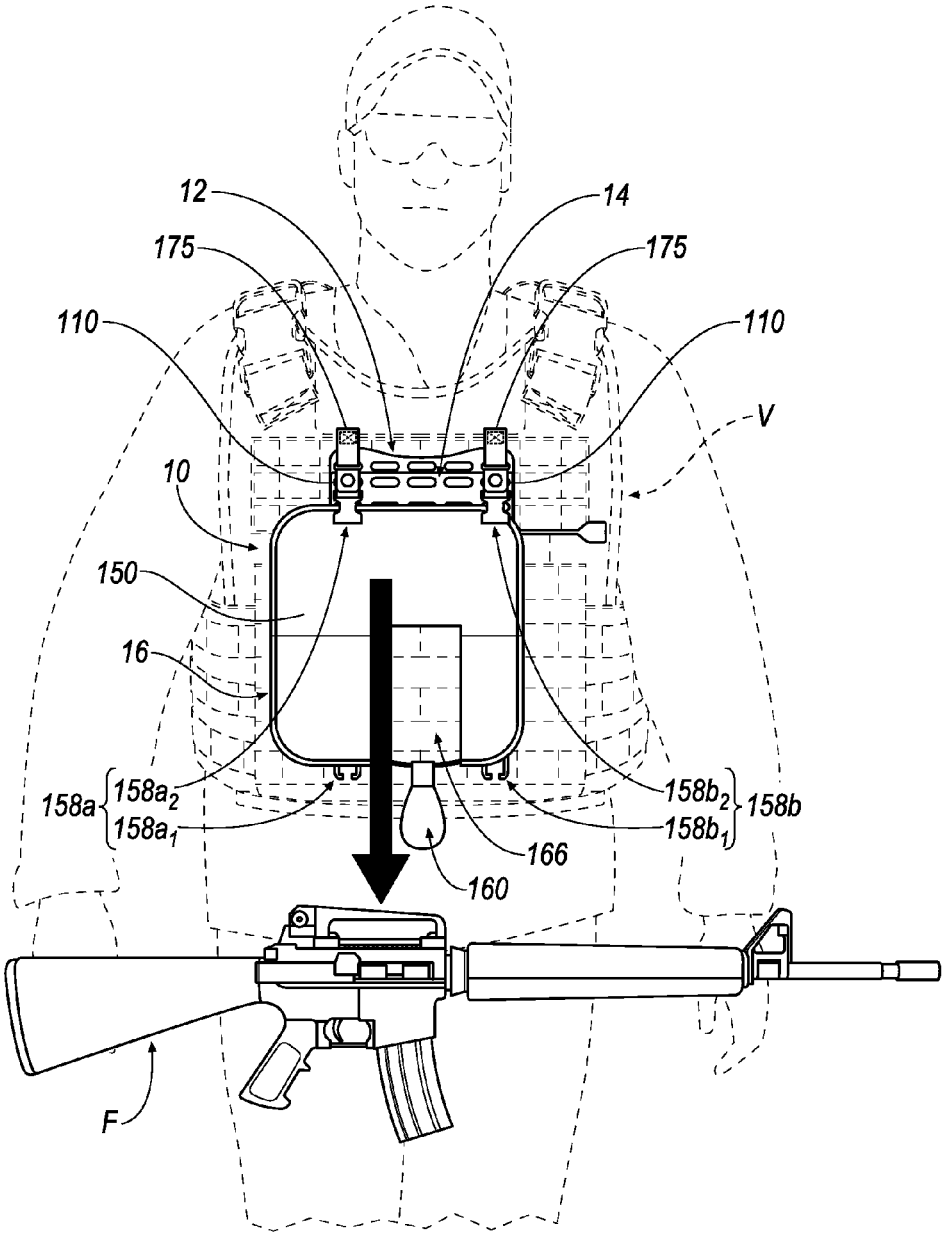

Referring to FIG. 19F, at any time the operator may desire to quickly deploy the firearm, F, from the hands-free support device 10. The operator may quickly deploy the firearm, F, by applying a pulling force, P, to the quick-release actuator 160 (as seen as described above at, e.g., FIGS. 1E-1F and 18A-18D). As seen in FIG. 19G, upon application of the pulling force, P, to the quick-release actuator 160, the quick-deployment implement retainer portion 16 may transition from a closed orientation as seen in FIG. 19F to a deployed orientation as seen in FIG. 19G, and, as a result, the hands-free support device 10 may quickly release the firearm, F, for use by the operator.

Referring to FIG. 20, unlike the exemplary embodiment described above at FIGS. 19A-19G, the hands-free support device 10 may be attached to something other than an article of clothing, such as, for example, one or more straps or a harness, H. The one or more straps or harness, H, may be disposed upon the operator's person in a substantially similar manner as an article of clothing such as, for example, the vest, V, described above.

Figure 21A:
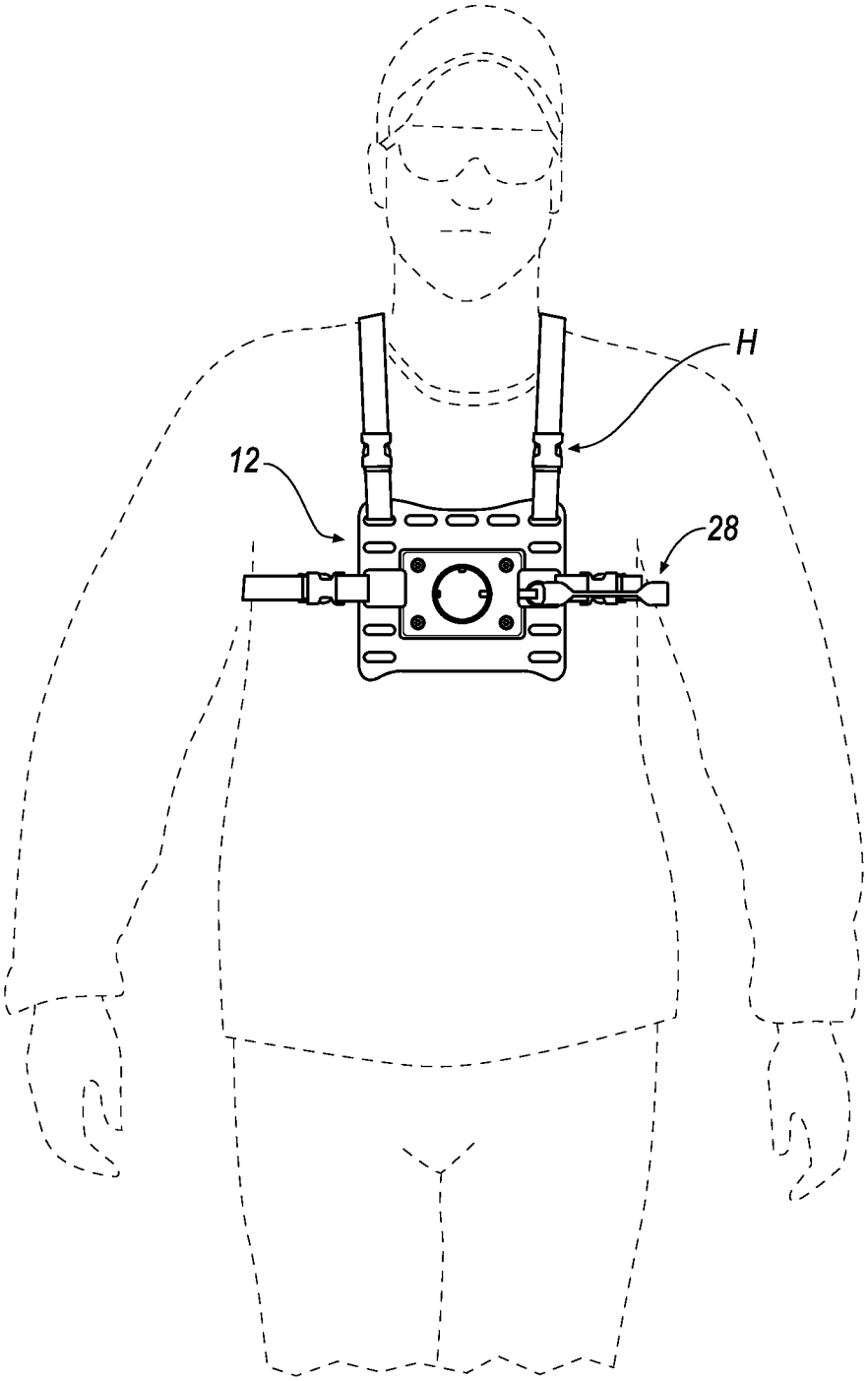
FIG. 21A is a view of the base portion of the hands-free support device of FIGS. 1A-1F attached to a harness relative an operator in a first "right side up" orientation such that a left-handed operator may utilize his/her left hand for actuating an actuator of the base portion.
Figure 21B:
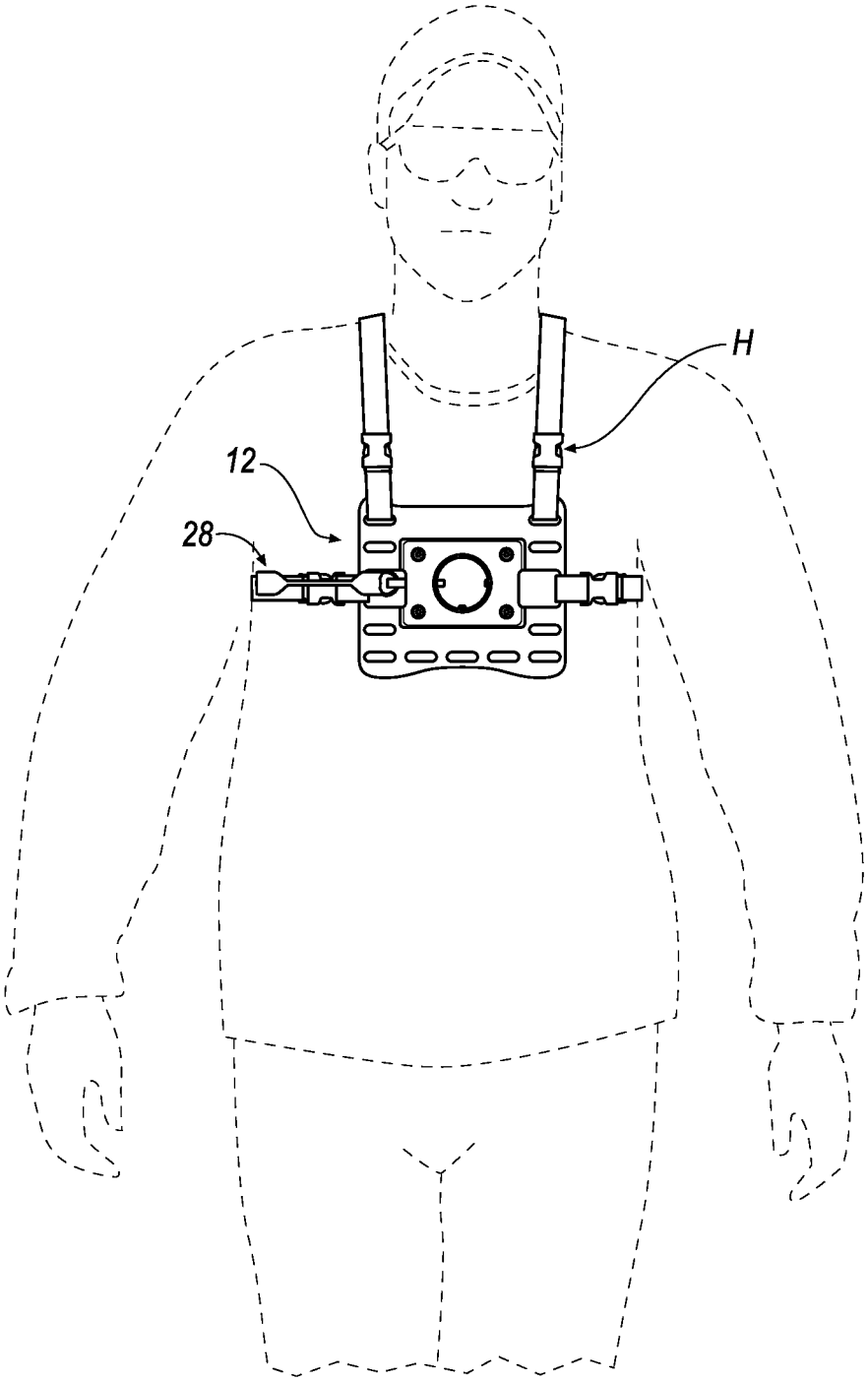
FIG. 21B is a view of the base portion of the hands-free support device of FIGS. 1A-1F attached to a harness relative an operator in a second/"upside down" orientation such that a right-handed operator may utilize his/her right hand for actuating an actuator of the base portion.

Referring to FIGS. 21A and 21B, the base portion 12 of the hands-free support device 10 is shown disposed upon an operator by way of a harness, H. As seen in FIG. 21A, the base portion 12 is shown relative an operator in a first/"right side up" orientation such that a left-handed operator may utilize his/her left hand for actuating the actuator 28. Conversely, as seen in FIG. 21B, the base portion 12 is shown relative an operator in a second/"upside down" orientation such that a right-handed operator may utilize his/her right hand for actuating the actuator 28.

Figure 22A:
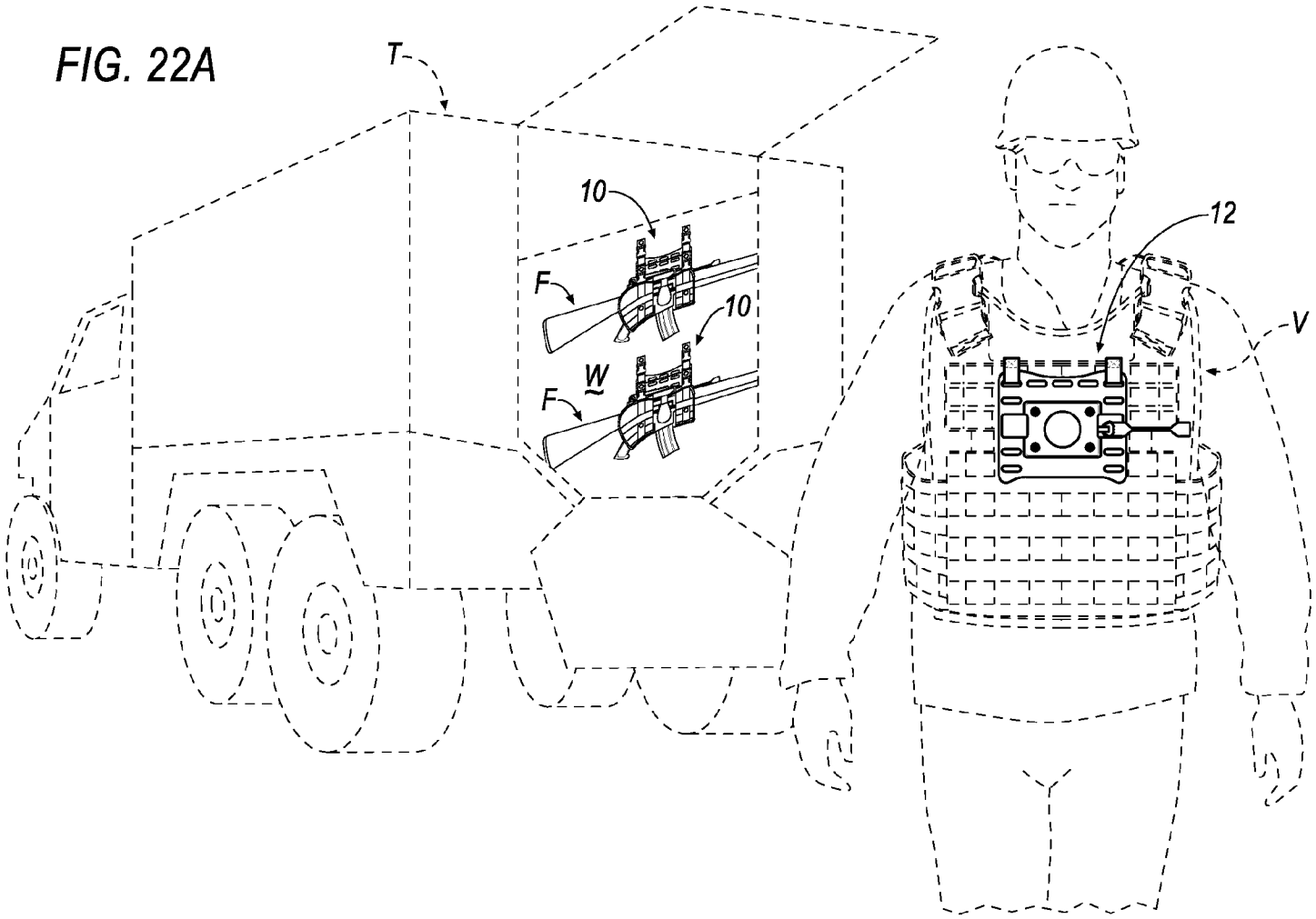
FIGS. 22A-22C are exemplary views of a methodology for handing-off the hands-free support device to/from a transport vehicle and an operator.
Figure 22B:
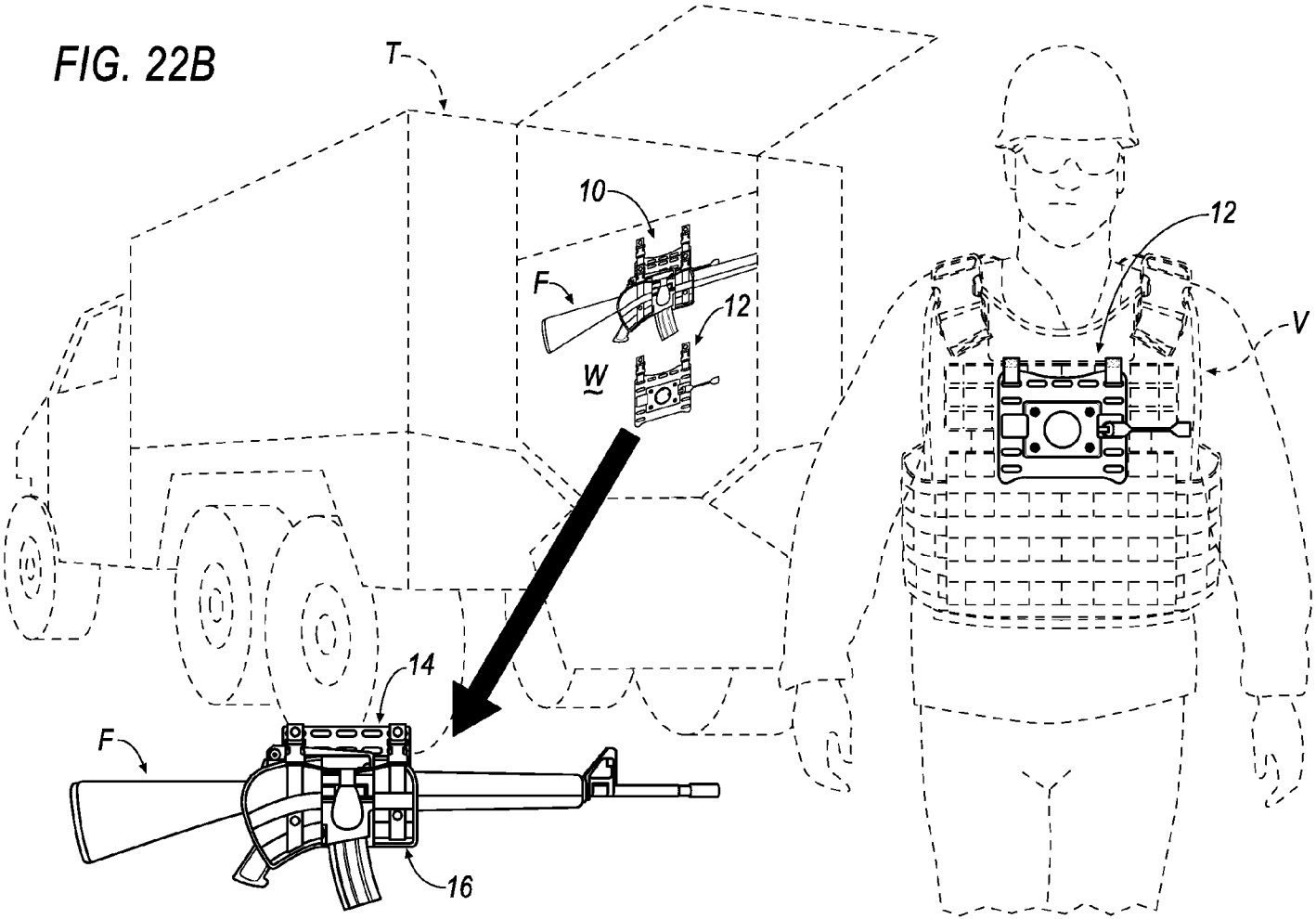
Figure 22C:
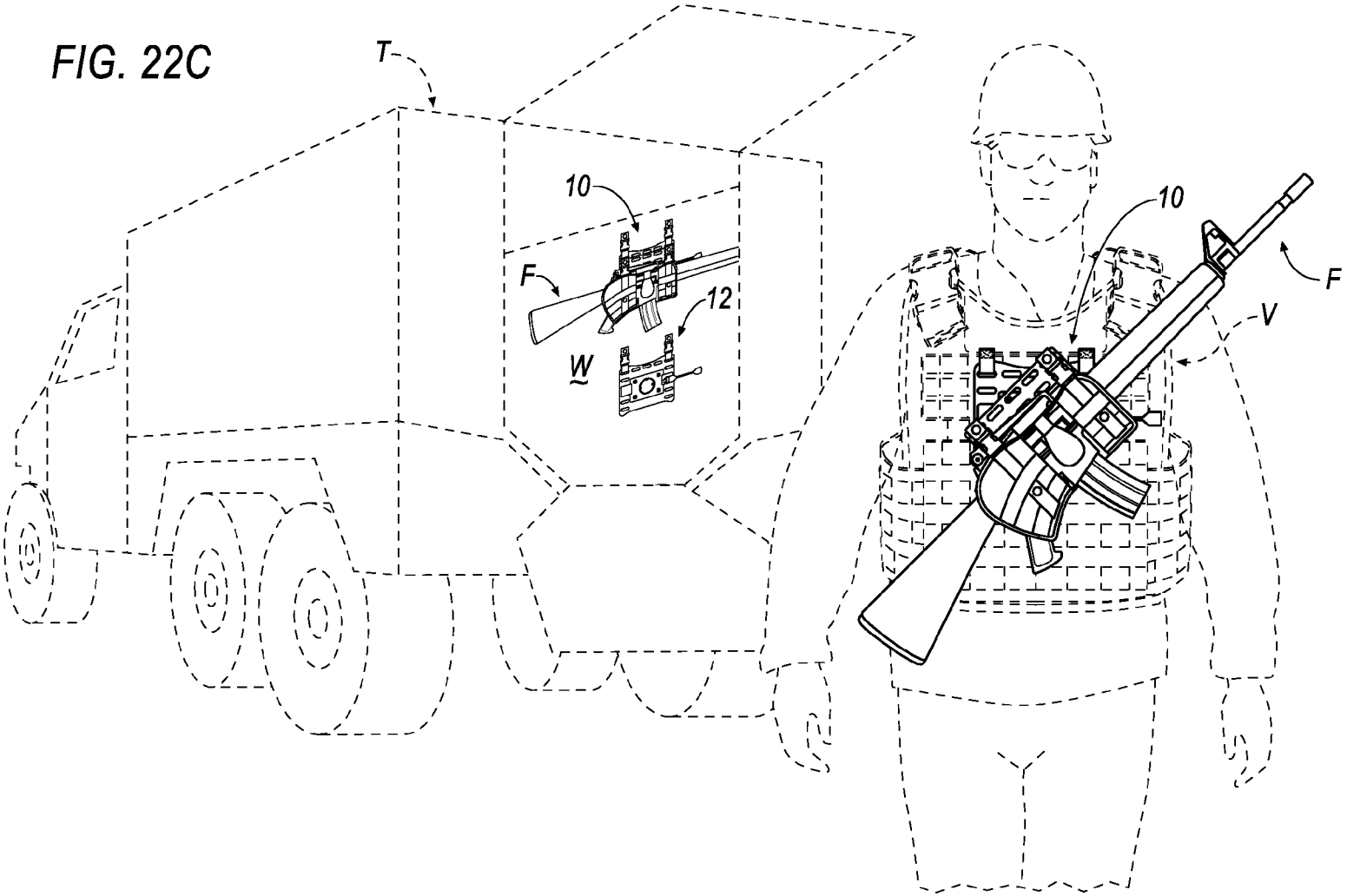

Referring to FIGS. 22A-22C, another exemplary methodology for utilizing the hands-free support device 10 is shown. Referring firstly to FIG. 22A, an operator is shown with a base portion 12 attached to a vest, V. Also seen in FIG. 22A is a vehicle, T, (e.g., a truck or military transport vehicle) including a plurality of hands-free support devices 10 (that respectively retain a firearm, F,) mounted to an interior wall, W, of the vehicle, T. In some instances, the base portion 12 of each hands-free support device 10 within the vehicle, T, may be fixed to the interior wall, W, of the vehicle, T.

Referring to FIG. 22B, the operator may detach the selectively rotatable portion 14 from the base portion 12 that is fixed to the interior wall, W, of the vehicle, T (i.e., by way of a reverse ordering of the attachment steps described above at FIGS. 16A-16C). By detaching the selectively rotatable portion 14 from the base portion 12 that is fixed to the interior wall, W, of the vehicle, T, the operator also removes the firearm, F, from the vehicle, T, which is attached to the selectively rotatable portion 14 by way of the quick-deployment implement retainer portion 16. Then, as seen in FIG. 22C, the operator may attach the selectively rotatable portion 14 to the base portion 12 that is attached to his/her vest, V.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. An assembly, comprising:

a base portion including a first subassembly attached to a second subassembly, wherein the first subassembly includes a housing that at least partially contains a rotation-locking actuator, wherein the second subassembly includes a housing receiver that retains the housing; and a selectively rotatable portion attached to the base portion, wherein the selectively rotatable portion includes:

an indexing member attached to an implement carrier portion, wherein the rotation-locking actuator of the base portion is selectively interfaced with the indexing member of the selectively rotatable portion in order to permit the selectively rotatable portion to be arranged relative the base portion in one of two positions, being:

a rotatably-locked position locked to the base portion, and a freely rotatable position free to rotate relative to the base portion.

2. The assembly according to claim 1, further comprising:

a quick-deployment implement retainer portion attached to the selectively rotatable portion.

3. The assembly according to claim 2, wherein the quick-deployment implement retainer portion further includes:

a substantially planar body of foldable material;

at least one distal strap portion attached to a distal end of the substantially planar body of foldable material; and at least one proximal strap portion attached to a proximal end of the substantially planar body of foldable material, wherein the at least one distal strap portion attaches the quick-deployment implement retainer portion to the selectively rotatable portion, wherein the at least one proximal strap portion is selectively attachable to the at least one distal strap portion in order to arrange the substantially planar body of foldable material in one of two conditions, being:

a deployed unfolded open condition, and a folded closed condition.

4. The assembly according to claim 3, wherein the quick-deployment implement retainer portion further includes:

at least one buckle member that attaches the at least one proximal strap portion to the proximal end of the substantially planar body of foldable material; and a quick-release actuator attached to the at least one buckle member to permit selective detaching of a male portion from a female portion of the at least one buckle member for transitioning the substantially planar body of foldable material from:

the folded closed condition to the deployed unfolded open condition.

5. The assembly according to claim 2, wherein the quick-deployment implement retainer portion removably contains an implement.

6. The assembly according to claim 5, wherein the implement is a firearm.

7. The assembly according to claim 1, further comprising:

an article of clothing attached to the base portion.

8. The assembly according to claim 7, wherein the article of clothing is a vest.

9. The assembly according to claim 1, further comprising:

a harness attached to the base portion.

10. The assembly according to claim 1, wherein the housing includes an axial passage and a radial passage that intersects with and is in fluid communication with the axial passage, a locking pin at least partially disposed within the radial passage, the locking pin having a collar portion that separates a length of the locking pin into a distal portion and proximal portion, a spring member circumscribing the locking pin and disposed within the radial passage, the spring member having a distal end and a proximal end, the distal end of the spring member disposed against a proximal shoulder surface of the collar portion of the locking pin, and a retaining washer disposed within the radial passage for removably-securing the locking pin and spring member within the radial passage, a distal surface of the retaining washer disposed against the proximal end of the spring member thereby compressing the spring member between the proximal shoulder surface of the locking pin and the distal surface of the retaining washer; and the housing is disposed within the housing receiver, and attached thereto by one or more fasteners.

11. The assembly according to claim 10, wherein compression of the spring member between the proximal shoulder surface of the collar portion of the locking pin and the distal surface of the retaining washer results in the spring member radially biasing the locking pin in a direction toward the axial passage of the housing for arranging a portion of a length of the distal portion of the locking pin within the axial passage.

12. The assembly according to claim 11, wherein the radial passage is defined by a non-constant diameter having a first shoulder surface and a second shoulder surface, wherein a distal shoulder surface of the collar portion of the locking pin is disposed against the first shoulder surface defining the radial passage, wherein the distal surface of the retaining washer is disposed against the second shoulder surface defining the radial passage.

13. The assembly according claim 11, wherein one of more alignment keys extend from the axial passage.

14. The assembly according to claim 10, wherein the retaining washer defines a passage that permits a portion of a length of the proximal portion of the locking pin to extend through the retaining washer such that the portion of the length of the proximal portion of the locking pin extends beyond an outer side surface of the housing.

15. The assembly according to claim 14, wherein the rotation-locking actuator of the base portion is connected to the length of the proximal portion of the locking pin that extends beyond an outer side surface of the housing.

16. The assembly according to claim 10, wherein the selectively rotatable portion includes an implement carrier portion, and an indexing member connected to the implement carrier portion by one or more fasteners, the indexing member inserted through an opening formed by the housing receiver and the axial passage of the housing, and the locking pin is selectively-interfaced with the indexing member for selectively rotatably-joining the selectively rotatable portion to the base portion.

17. The assembly according to claim 16, wherein the indexing member has a substantially cylindrical body with a front surface, a rear surface and a substantially circumferential side surface, the substantially circumferential side surface defining a recessed circumferential channel and alignment key channels that are in fluid communication with the recessed circumferential channel, the alignment key channels extending from the rear surface of the indexing member, and one of more of the alignment keys are arranged within the recessed circumferential channel by way of the alignment key channels.

18. The assembly according to claim 17, wherein the recessed circumferential channel further defines a plurality of locking pin receiving passages, wherein the portion of the length of the distal portion of the locking pin is selectively-disposed in a locking pin receiving passage of the plurality of locking pin receiving passages for selectively rotatably-joining the selectively rotatable portion to the base portion.

19. A method for operating a hands-free support device, comprising:

providing a hands-free support device assembly having a base portion including a first subassembly attached to a second subassembly, the first subassembly including a housing that at least partially contains a rotation-locking actuator, the second subassembly including a housing receiver that retains the housing, a selectively rotatable portion attached to the base portion which includes an indexing member, a quick-deployment implement carrier portion secured to the selectively rotatable portion, and a quick-release actuator selectively interfaced with the quick-deployment implement carrier portion, wherein the rotation-locking actuator of the base portion is selectively interfaced with the indexing member of the selectively rotatable portion;

arranging the selectively rotatable portion relative to the base portion in a first selectively rotatably-locked position locked to the base portion;

actuating the actuator to unlock the selectively rotatable portion from the base portion so as to freely rotate relative to the base portion;

rotating the selectively rotatable portion relative to the base portion; and after rotating the selectively rotatable portion relative to the base portion, releasing the actuator for to lock the selectively rotatable portion relative to the base portion in a second selectively rotatably-locked position that is different than the first selectively rotatably-locked position.

20. The method according to claim 19, further comprising;

removably-securing an implement within the quick-deployment implement retainer portion; and actuating the quick-release actuator to transition the quick-deployment implement retainer portion from:

a closed condition to an open deployed condition for selectively-releasing the implement from the quick-deployment implement retainer portion.

* * * * *